US011064853B2

(12) United States Patent
Clare et al.

(10) Patent No.: US 11,064,853 B2
(45) Date of Patent: Jul. 20, 2021

(54) UPRIGHT VACUUM CLEANER INCLUDING MAIN BODY MOVING INDEPENDENTLY OF WAND TO REDUCE MOVEMENT OF MAIN BODY CENTER OF GRAVITY

(71) Applicant: SHARKNINJA OPERATING LLC, Needham, MA (US)

(72) Inventors: David S. Clare, London (GB); Mingshun Su, Suzhou (CN); Ming Yao, Suzhou (CN)

(73) Assignee: SharkNinja Operating LLC, Needham, MA (US)

( * ) Notice: Subject to any disclaimer, the term of this patent is extended or adjusted under 35 U.S.C. 154(b) by 124 days.

(21) Appl. No.: 16/407,850

(22) Filed: May 9, 2019

(65) Prior Publication Data

US 2019/0343349 A1 Nov. 14, 2019

Related U.S. Application Data

(60) Provisional application No. 62/669,008, filed on May 9, 2018.

(51) Int. Cl.

| | |
|---|---|
| ***A47L 9/00*** | (2006.01) |
| ***A47L 9/32*** | (2006.01) |
| ***A47L 5/28*** | (2006.01) |

(52) U.S. Cl.

CPC ..... *A47L 9/0018* (2013.01); *A47L 5/28* (2013.01); *A47L 9/325* (2013.01)

(58) Field of Classification Search

CPC . A47L 5/28; A47L 5/30; A47L 9/0018; A47L 9/248; A47L 9/325

See application file for complete search history.

(56) References Cited

U.S. PATENT DOCUMENTS

| | | | | |
|---|---|---|---|---|
| 4,393,536 | A | 7/1983 | Tapp | |
| 5,794,305 | A | 8/1998 | Weger | |
| 6,058,559 | A | 5/2000 | Yoshimi | |
| 6,101,672 | A | 8/2000 | Conrad | |
| 6,105,204 | A * | 8/2000 | Scharwat | B08B 3/024 15/322 |
| 6,334,234 | B1 | 1/2002 | Conrad | |
| 6,735,818 | B2 | 5/2004 | Hamada | |
| 7,600,292 | B2 | 10/2009 | Courtney | |
| 7,805,804 | B2 | 10/2010 | Loebig | |
| 7,854,039 | B2 | 12/2010 | Lee | |

(Continued)

FOREIGN PATENT DOCUMENTS

| | | | |
|---|---|---|---|
| JP | H01204633 | A | 8/1989 |
| JP | 2002223993 | A | 8/2002 |
| JP | 2006255305 | A | 9/2006 |

OTHER PUBLICATIONS

PCT Search Report and Written Opinion dated Aug. 2, 2019, received in PCT Application No. PCT/US19/31525, 8 pgs.

*Primary Examiner* — Marc Carlson
(74) *Attorney, Agent, or Firm* — Grossman Tucker Perreault & Pfleger, PLLC

(57) ABSTRACT

A vacuum cleaner may include a surface cleaning head, a wand pivotally coupled to the surface cleaning head, and a rotatable canister mount. The rotatable canister mount may include a support through which at least a portion of the wand extends such that the canister mount rotates relative to the wand in response to the wand pivoting.

20 Claims, 25 Drawing Sheets

(56) References Cited

U.S. PATENT DOCUMENTS

| | | | | |
|---|---|---|---|---|
| 7,950,102 | B2 * | 5/2011 | Lee | A47L 5/28 15/327.4 |
| 8,060,981 | B2 | 11/2011 | Bassett | |
| 8,082,624 | B2 | 12/2011 | Myers | |
| 8,151,408 | B2 | 4/2012 | Finke et al. | |
| 8,181,309 | B2 | 5/2012 | Mersmann et al. | |
| 8,375,508 | B2 | 2/2013 | Conrad | |
| 8,448,295 | B2 | 5/2013 | Davidshofer | |
| 8,627,545 | B2 | 1/2014 | Streciwilk | |
| 8,667,643 | B2 | 3/2014 | Simonelli | |
| 8,813,308 | B2 | 8/2014 | Xue | |
| 8,869,349 | B2 | 10/2014 | Henderson | |
| 8,943,647 | B1 | 2/2015 | Henderson | |
| 9,125,537 | B2 | 9/2015 | Seo | |
| 9,254,069 | B2 | 2/2016 | Kim et al. | |
| 9,282,862 | B2 | 3/2016 | Henderson et al. | |
| 2005/0223516 | A1 * | 10/2005 | Courtney | A47L 9/0054 15/351 |
| 2008/0022483 | A1 | 1/2008 | Potoroka | |
| 2009/0056065 | A1 * | 3/2009 | Finke | A47L 9/009 15/354 |
| 2009/0144929 | A1 | 6/2009 | Yoo | |
| 2009/0165242 | A1 | 7/2009 | Lee et al. | |
| 2010/0132155 | A1 * | 6/2010 | Brough | A47L 9/122 15/352 |
| 2013/0086768 | A1 * | 4/2013 | Nishimura | A47L 9/325 15/354 |
| 2015/0040342 | A1 | 2/2015 | Henderson | |
| 2015/0351596 | A1 * | 12/2015 | Thorne | A47L 9/322 15/332 |
| 2016/0157687 | A1 * | 6/2016 | Perez | A47L 5/28 15/331 |
| 2016/0157690 | A1 | 6/2016 | Streciwilk | |
| 2016/0324381 | A1 * | 11/2016 | Kasper | A47L 9/165 |
| 2017/0020353 | A1 * | 1/2017 | Park | A47L 9/325 |
| 2017/0127896 | A1 * | 5/2017 | Carter | A47L 5/34 |
| 2018/0235425 | A1 * | 8/2018 | Ding | A47L 11/161 |

* cited by examiner

UPRIGHT VACUUM CLEANER INCLUDING MAIN BODY MOVING INDEPENDENTLY OF WAND TO REDUCE MOVEMENT OF MAIN BODY CENTER OF GRAVITY

CROSS-REFERENCE TO RELATED APPLICATIONS

The present application claims the benefit of U.S. Provisional Application Ser. No. 62/669,008, filed on May 9, 2018, entitled UPRIGHT VACUUM CLEANER INCLUDING MAIN BODY MOVING INDEPENDENTLY OF WAND TO REDUCE MOVEMENT OF MAIN BODY CENTER OF GRAVITY, which is fully incorporated herein by reference.

TECHNICAL FIELD

The present disclosure relates generally to vacuum cleaners and more specifically to an upright vacuum cleaner including a main body moving independently of a wand to reduce movement of the main body center of gravity.

BACKGROUND INFORMATION

Vacuum cleaners, such as an upright vacuum cleaner, may include a wand, a surface cleaning head and a main body, such as a canister including a debris collector and/or a suction motor, mounted to the wand. The main body may be fixedly coupled to the wand such that the mass of the main body is substantially supported by the wand and movement of the wand results in the main body moving to the same extent as the wand. In these upright vacuum cleaners, a center of gravity of the main body is usually located in front of the wand.

Some upright vacuum cleaners include a multiple axis joint or swivel joint to allow the surface cleaning head to be steered by swiveling the wand. Swiveling the wand to steer the surface cleaning head causes the wand to rotate about a wand longitudinal axis. As a result, the fixed main body also rotates about the wand longitudinal axis and generates a torque when the main body moves with the wand to each side. When the mass of the main body is offset to one side, the torque may cause the wand to rotate further and make it difficult to push the surface cleaning head in a straight line. The torque may also make it difficult for an operator to return the wand to the original centered position. As a result of this torque, an operator of the vacuum cleaner may be required to exert additional force on the wand (often referred to as wrist torque) to maneuver or steer the vacuum cleaner. As a result, the act of cleaning a surface may become more tiresome to an operator of the vacuum cleaner.

BRIEF DESCRIPTION OF THE DRAWINGS

These and other features and advantages will be better understood by reading the following detailed description, taken together with the drawings, wherein.

DETAILED DESCRIPTION

An upright vacuum cleaner, consistent with embodiments disclosed herein, includes a main body (e.g., a canister with a debris collector and/or suction motor) that moves independently of a wand to reduce movement of a center of gravity of the main body, thereby reducing the magnitude of the torque generated by the main body. An embodiment of the upright vacuum cleaner includes a wand coupled to a surface cleaning head with a multiple axis pivot joint and a rotatable canister mount that is rotatable relative to the wand in response to rotating the wand about a wand longitudinal axis (e.g., when swiveling the wand to steer the surface cleaning head). This results in rotating the main body and its center of gravity to a lesser extent, reducing the torque generated by the main body and thus reducing the wrist torque and makes the vacuum cleaner easier to maneuver or steer (e.g., as compared to a vacuum cleaner with a canister that moves identically with the wand).

As used herein, "wand" refers to an elongated structure extending from the surface cleaning head to the handle of a vacuum cleaner for maneuvering the surface cleaning head and may have various shapes and/or configurations. In some embodiments, the wand may include an air passageway extending at least partially therethrough, although this is not a limitation. As used herein, "multiple axis pivot joint" refers to any joint coupling the wand to the surface cleaning head such that the wand is pivotable about at least two axes. As used herein, "independent movement" or "moving independently" refers to an object moving with at least one degree of freedom relative to another object.

Figure 1:
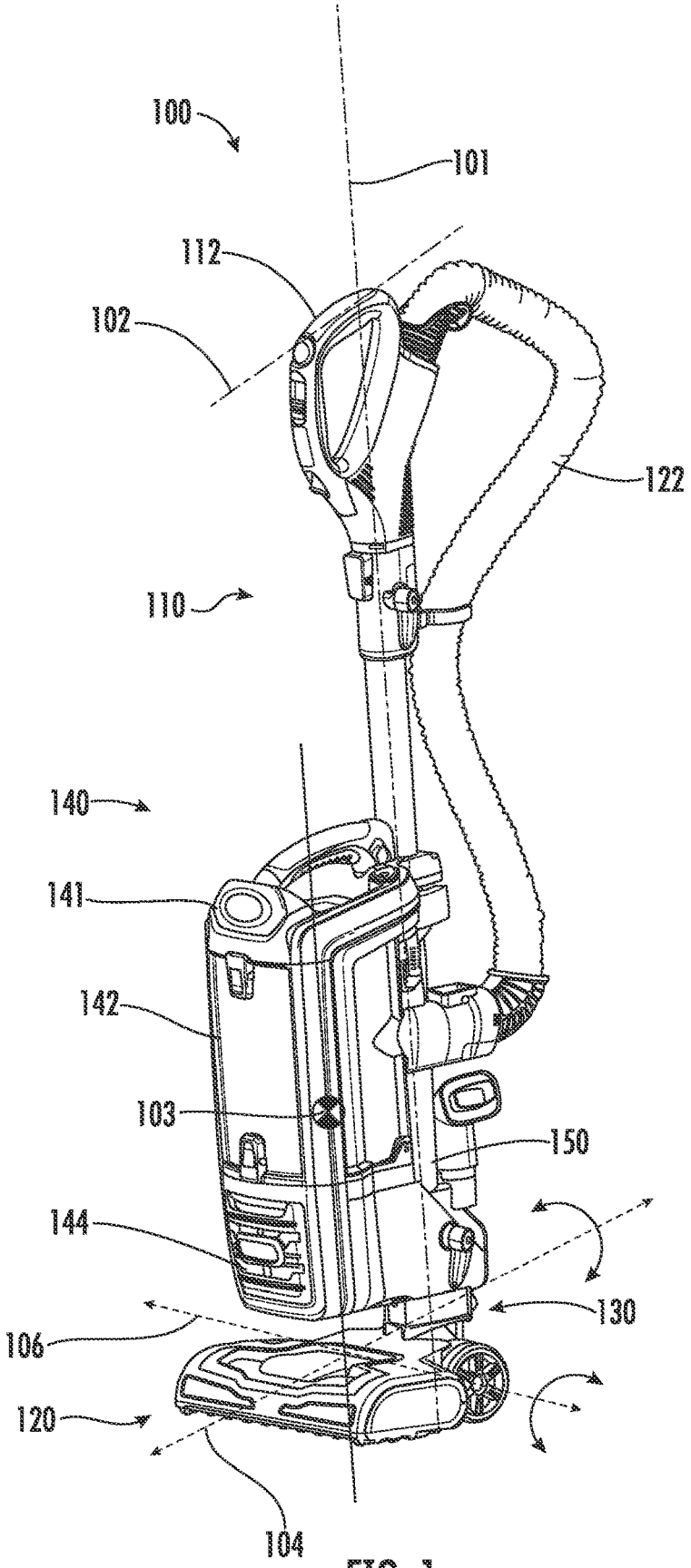
FIG. 1 is a perspective view of an upright vacuum cleaner including an independently movable main body, consistent with embodiments of the present disclosure.

Referring to FIG. 1, an upright vacuum cleaner 100, consistent with embodiments of the present disclosure, is shown and described. In general, the upright vacuum cleaner 100 includes a wand 110 coupled to a surface cleaning head 120 with a multiple axis pivot joint 130 and a main body 140 mounted to and at least partially supported by the wand 110. The main body 140 is mounted such that a center of gravity 103 of the main body 140 moves independently of the wand 110, as will be described in greater detail herein. One example of an upright vacuum cleaner is disclosed in greater detail in U.S. Patent Application Publication No. 2015/0351596, which is incorporated herein by reference. Although one example of an upright vacuum cleaner is shown and described, other types of upright vacuum cleaners may also implement the concepts described herein such that a main body moves independently of a wand.

In the illustrated embodiment, the wand 110 is pivotally coupled to the surface cleaning head 120 at one end and includes a handle 112 at an opposite end of the wand 110. A wand longitudinal axis 101 extends longitudinally along the wand 110 and a transverse axis 102 extends transverse to the wand longitudinal axis 101, for example, along the handle 112. The main body 140 is mounted to the wand 110 such that the center of gravity 103 is spaced apart from the wand longitudinal axis 101 in a forward direction such that at least a portion of the main body 140 is positioned over the surface cleaning head 120. The main body 140 includes, for example, a canister 141 with a debris collector 142 and a suction motor 144 fluidly coupled thereto. The canister 141 is also fluidly coupled to the surface cleaning head 120, for example, via a hose 122 and an air passageway through the wand 110. In this embodiment, the suction motor 144 generates a vacuum within the debris collector 142 such that debris is drawn from the surface to be cleaned through a dirty air inlet (not shown) of the surface cleaning head 120, through the air passageway in the wand 110, through the hose 122, and is deposited within the debris collector 142. The surface cleaning head 120 may also include a rotating brush roll and leading roller (not shown), for example, as disclosed in U.S. Patent Application Pub. No. 2017/0127896, which is incorporated herein by reference. The canister 141 may be a removable canister that is removably mounted to a canister mount 150 coupled to the wand 110. The canister mount 150 may be movably coupled relative to the wand 110 (e.g., rotatable about the wand 110) to allow the canister mount 150 and canister 141 mounted thereon to move independently of the wand 110, as will be described in greater detail herein.

In this embodiment, the wand 110 is pivotally coupled to the surface cleaning head 120 with the multiple axis pivot joint 130 such that the wand 110 is capable of pivoting about at least first and second axes 104, 106. The first axis 104 may generally be described as being parallel with a direction of movement of the vacuum cleaner 100 to allow the wand 110 to pivot from side to side, and the second axis 106 may generally be described as being transverse to the direction of movement of the vacuum cleaner 100 to allow the wand 110 to pivot forward and backward. The combination of pivoting about both axes 104, 106 allows the wand 110 to be swiveled while moving the surface cleaning head 120 to maneuver or steer the surface cleaning head 120 over a surface to be cleaned (e.g., a floor). This swiveling of the wand 110 while moving and steering the surface cleaning head 120 results in the wand 110 rotating generally about the wand longitudinal axis 101.

Figure 2A:
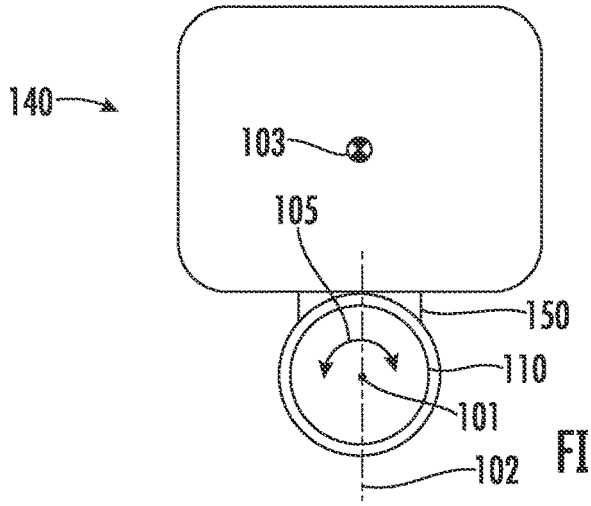
FIG. 2A is a schematic view of an upright vacuum cleaner with a main body coupled to a wand, consistent with embodiments of the present disclosure.
Figure 2B:
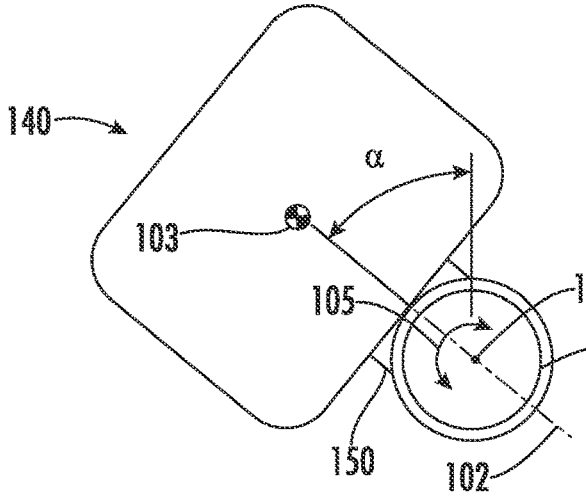
FIG. 2B is schematic view of an example of the upright vacuum cleaner of FIG. 2A, wherein the main body rotates with the wand, consistent with embodiments of the present disclosure.
Figure 2C:
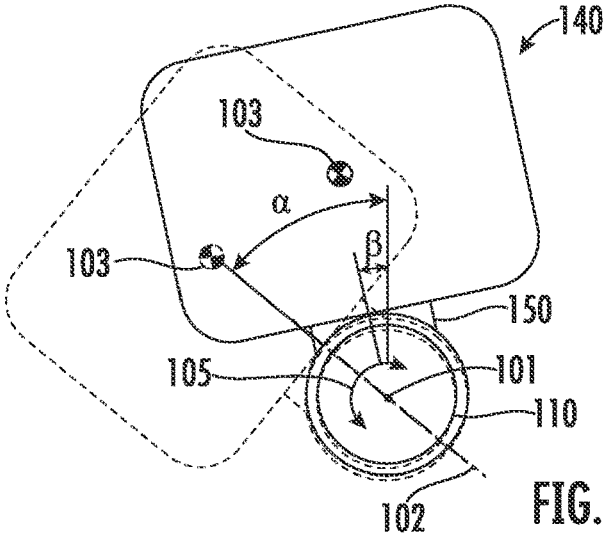
FIG. 2C is schematic view of an example the upright vacuum cleaner of FIG. 2A, wherein, in response to a rotation of the wand, the main body rotates to a lesser extent than the wand, consistent with embodiments of the present disclosure.

This rotational movement of the wand 110 is shown schematically in FIGS. 2A-2C. The swiveling of the wand 110 results in a generally rotational motion of the wand 110 about the wand longitudinal axis 101, as illustrated by arrow 105 and the angular movement of the transverse axis 102. If the main body 140 (e.g., the canister 141) is fixed to the wand 110 with no degrees of freedom, the main body 140 and the center of gravity 103 of the main body 140 will rotate identically with the wand 110 to the same extent or rotation angle α (see FIG. 2B). Rotation of the main body 140 and its center of gravity 103 relative to the wand longitudinal axis 101 causes torque, which may facilitate rotation to the side (e.g., FIG. 2B) but makes it more difficult to rotate back to and/or maintain a centered or upright position (e.g., FIG. 2A). If the main body 140 is movable relative to the wand 110 with an added degree of freedom (e.g., the canister mount 150 is rotatable relative to the wand 110), when the wand 110 is rotated, the main body 140 and its center of gravity 103 rotate to a lesser extent, i.e., a smaller rotation angle β as compared to the wand rotation angle α (see FIG. 2C). As such, the wrist torque required to hold the main body in an upright position (e.g., to steer in a straight line) and to move the main body 140 back to its upright position may be reduced.

According to some examples, the multiple axis pivot joint 130 allows the wand 110 to be rotated to a wand rotation angle α in a range of about 0° to 90° to either side. By allowing the main body 140 to move independently, the main body 140 may be rotated to a main body rotation angle β in a range of about 0° to 45°, when, for example, the vacuum cleaner 100 is in an at least partially reclined position (e.g., the wand 110 is tilted relative to the surface cleaning head 120). In other words, in some instances, the wand 110 may have a rotation angle that is double the rotation angle of the main body 140. Although the main body 140 may still move with the wand 110 to some extent, the movement of the main body 140 is at least partially decoupled from the movement of the wand 110 such that the main body 140 moves to a lesser extent. The difference between the wand rotation angle α and the main body rotation angle β is thus greater than 0° but may vary, for example, depending on the desired wrist torque. In some embodiments, the main body 140 may not rotate at all when the wand 110 is rotated. In other embodiments, the main body 140 may rotate almost as much as the wand 110. In some instances, the independent rotation of the main body 140 may also be dependent on the position of the wand 110 relative to the surface being cleaned. For example, when the wand 110 is tilted all the way back, the main body 140 may not rotate at all when the wand 110 is rotated. In other words, as the wand 110 is tilted back towards a reclined or in-use position (e.g., towards a user), an amount of rotation of the main body 140 relative to the wand 110 that occurs in response to a corresponding rotation in the wand 110 decreases. In some instances, with continued reclining of the wand 110, a rotation of the wand 110 in a first direction may result in a corresponding rotation of the main body 140 in a second direction, the first direction being opposite the second direction.

Figure 3A:
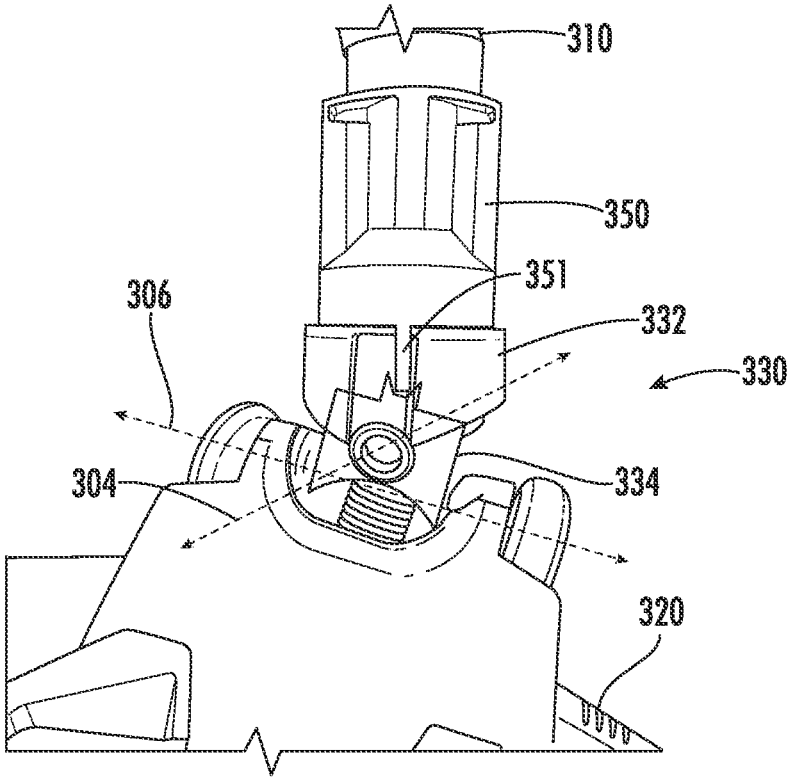
FIG. 3A is a perspective view of a multiple axis pivot joint having an independently movable canister mount, consistent with embodiments of the present disclosure.
Figure 3B:
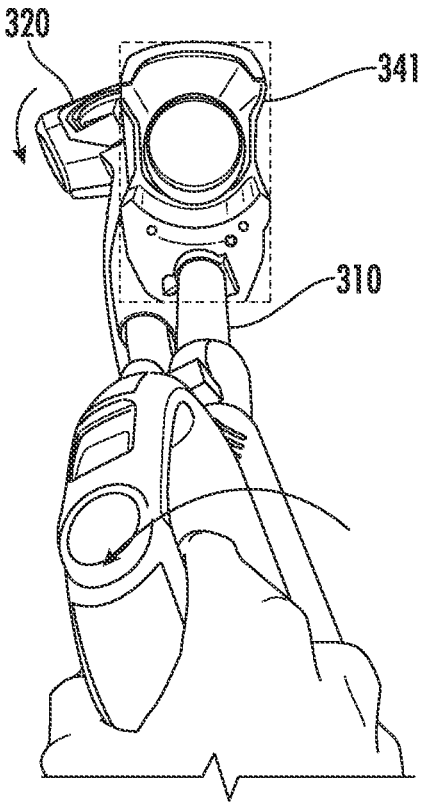
FIG. 3B is a top perspective view illustrating movement of a main body relative to a wand of an upright vacuum cleaner, consistent with embodiments of the present disclosure.
Figure 3C:
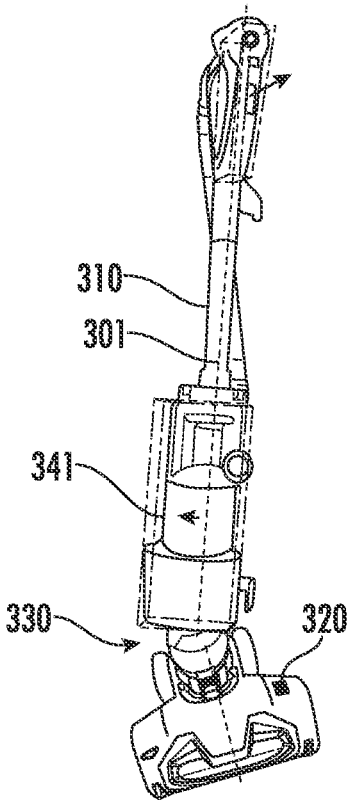
FIG. 3C is a front perspective view illustrating movement of a main body relative to a wand of an upright vacuum cleaner, consistent with embodiments of the present disclosure.

FIGS. 3A-3C show an embodiment of a multiple axis pivot joint 330 for coupling a wand 310 (which may be an example of the wand 110 of FIG. 1) to a surface cleaning head 320 (which may be an example of the surface cleaning head 120 of FIG. 1) and a rotatable canister mount 350 capable of supporting at least a canister 341 (which may be an example of the canister 141 of FIG. 1) with independent movement relative to the wand 310. The canister 341 may include and/or be coupled to, for example, a debris collector and/or a suction motor. For example, when the cannister 341 is coupled to a suction motor, the canister 341 and the suction motor may collectively be referred to as a main body. As shown in FIG. 3A, the multiple axis pivot joint 330 is a two axis pivot joint, like a universal joint or swivel joint, including an upper pivoting member 332 that pivots about a first pivot axis 304 and a lower pivoting member 334 that pivots about a second pivot axis 306. The upper pivoting member 332 may include or be coupled to the wand 310 and the lower pivoting member 334 is pivotally coupled to the surface cleaning head 320.

In this embodiment, the canister mount 350 is rotatably coupled to the wand 310 and engages the lower pivoting member 334 proximate a bottom end 351 of the canister mount 350 such that movement of the canister mount 350 with the wand 310, when the wand 310 pivots about the first pivot axis 304, is resisted thereby causing the canister mount 350 (and a canister mounted thereon) to rotate relative to the wand 310. When the wand 310 is swiveled to steer the surface cleaning head 320, the wand 310 is rotated about the wand longitudinal axis 301 independently of the canister 341 mounted to the canister mount 350, as shown in FIGS. 3B and 3C. Engaging the lower portion of the canister mount 350 when the wand 310 rotates causes the canister mount 350 to rotate to a lesser extent such that the canister mount 350 and canister 341 mounted thereon remains more upright during steering. Although the canister 341 does not drop to the side in FIG. 3B when the wand is swiveled to steer to the left, embodiments of the present disclosure may allow some movement of the canister 341 with the wand 310.

Referring to FIGS. 4-8, an embodiment of a multiple axis pivot joint 430 with a rotatable canister mount 450 is shown and described in greater detail. In this embodiment, an upper pivoting member 432 of the multiple axis pivot joint 430 includes a neck 433 and a lower pivoting member 434 of the multiple axis pivot joint 430 includes a base portion 435. The neck 433 and the base portion 435 define at least a portion of an airflow passageway 436. The base portion 435 may be fluidly coupled to a surface cleaning head (not shown) via an inlet 421 and the neck 433 may be fluidly coupled to a wand (not shown) such that air flows from the surface cleaning head through the base portion 435, through neck 433, and through the wand to a hose coupled to a canister, for example, as described above and shown in FIG. 1.

The neck 433 may be pivotally coupled to the base portion 435 at a first neck pivot point 438*a* and a second neck pivot point 438*b* such that the neck 433 can pivot about a first or neck pivot axis 404 extending through first and second neck pivot points 438*a*, 438*b*. The first neck pivot point 438*a* and the second neck pivot point 438*b* may be vertically offset from each other such that the neck pivot axis 404 forms an angle θ relative to a horizontal plane 409 (e.g., a surface to be cleaned). In some instances, for example, the angle θ may be in a range of, for example, 5° to 60°. By way of further example, the angle θ may be in a range of 20° to 35°.

The neck 433 and base portion 435 may also pivot about a second or base pivot axis 406. The base pivot axis 406 may extend through a set of base pivot points 439*a*, 439*b*. The base pivot axis 406 may be transverse to the neck pivot axis 404 such that, for example, a direction of pivot about the base pivot axis 406 is substantially perpendicular to a direction of pivot about the neck pivot axis 404. Each of the base pivot points 439*a*, 439*b* may be coupled to, for example, a surface cleaning head (such as, for example, the surface cleaning head 120 of FIG. 1). The pivoting of the neck 433 and the base portion 435 about the respective axes 404, 406 allows a wand coupled to the neck 433 to be swiveled when steering, thereby resulting in rotation of the wand and the neck 433 about a wand longitudinal axis 401.

Figure 4:
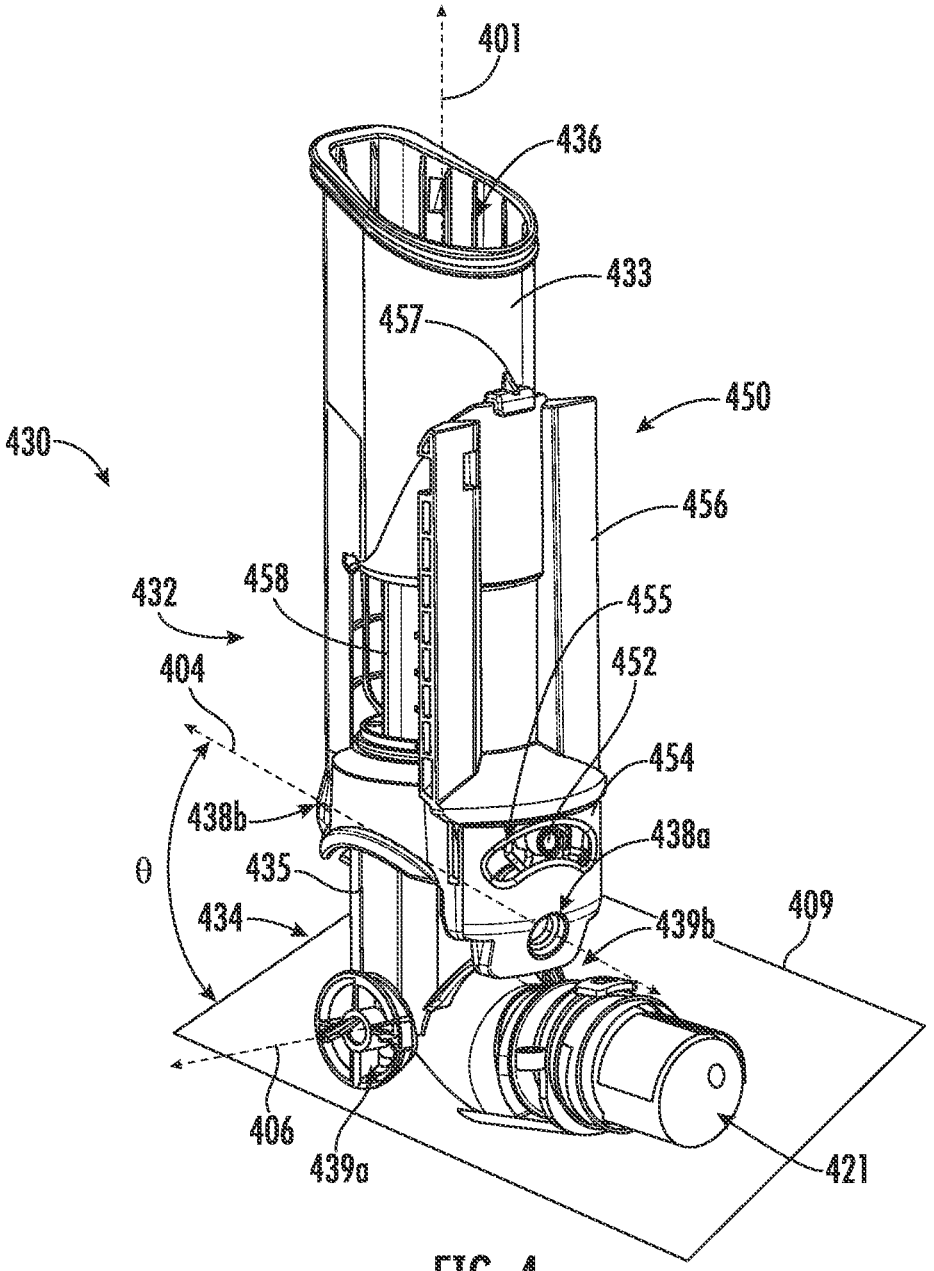
FIG. 4 is a perspective view of an embodiment of a multiple axis pivot joint and rotatable canister mount assembly for use in the upright vacuum cleaner shown in FIG. 1 to provide independent movement of the main body, consistent with embodiments of the present disclosure.
Figure 4B:
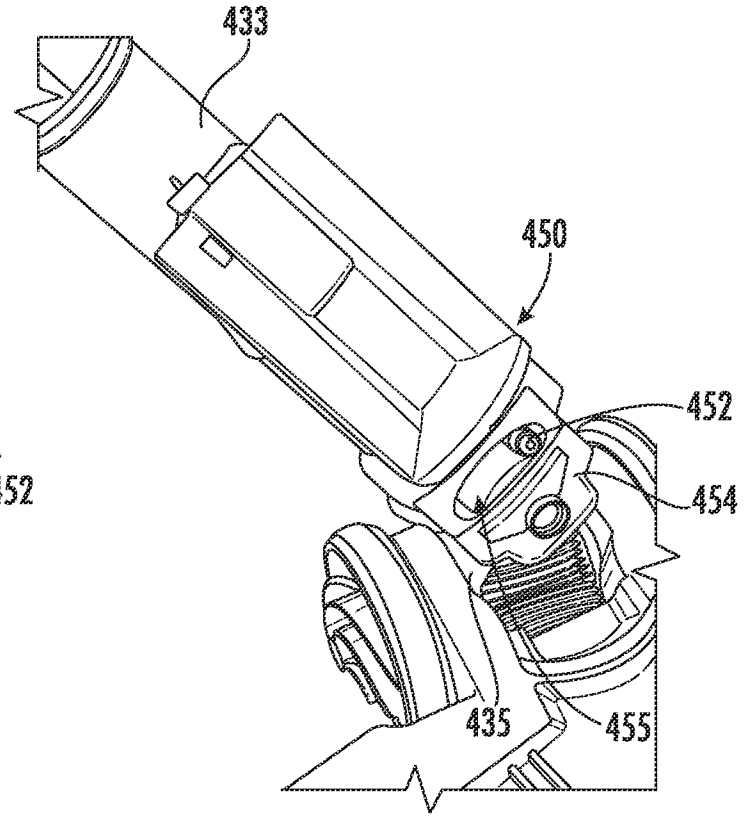
FIG. 4B is a perspective view illustrating a second pivoted position of the multiple axis pivot joint and canister mount assembly shown in FIG. 4, consistent with embodiments of the present disclosure.
Figure 4A:
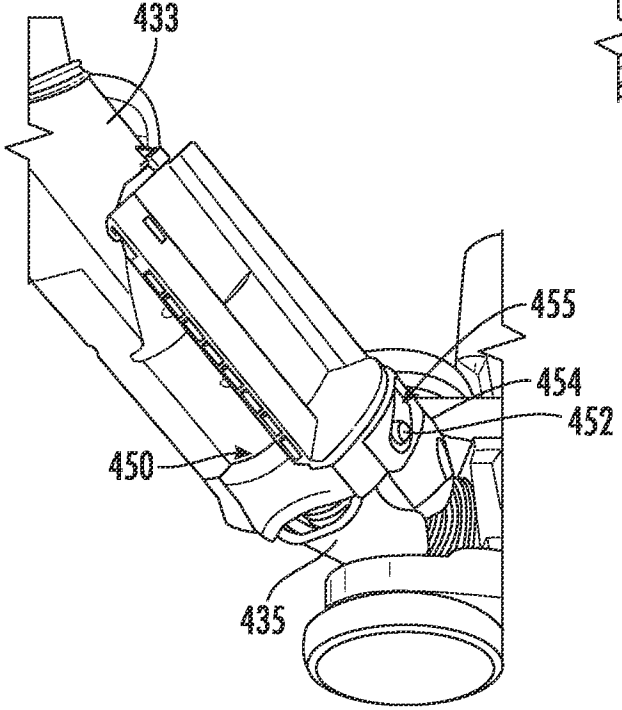
FIG. 4A is a perspective view illustrating a first pivoted position of the multiple axis pivot joint and canister mount assembly shown in FIG. 4, consistent with embodiments of the present disclosure.

The rotatable canister mount 450 may be rotatably coupled to the neck 433 (e.g., to rotate around the neck 433) and coupled to the base portion 435 (e.g., using a pin 452) such that, when the neck 433 is pivoted relative to the base portion 435 about the neck pivot axis 404, movement of the canister mount 450 relative to the neck 433 about at least one axis (e.g., the wand longitudinal axis 401) is resisted. This resistance of movement causes the neck 433 to rotate relative to the movable canister mount 450 when the neck 433 rotates about the wand longitudinal axis 401 as a result of swiveling the wand about both axes 404, 406 to steer the surface cleaning head (not shown). As such, the rotatable canister mount 450 (and a canister mounted thereon) moves independently and to a lesser extent than the movement of the neck 433 and the wand. FIGS. 4A and 4B show the neck 433 pivoted to each side in two different positions with the pin 452 engaging a bottom portion of the rotatable canister mount 450 to resist and/or at least partially restrict movement about at least one axis with the neck 433.

When the neck 433 pivots about the neck pivot axis 404, the degree of pivot may be visualized using a plate 454 coupled to (or integrally formed from) the neck 433, as shown in greater detail in FIGS. 4A and 4B. As shown, the plate 454 includes an arcuate shaped cutout 455 that receives the pin 452 extending from the base portion 435. As such, as the neck 433 pivots about the neck pivot axis 404, the arcuate shaped cutout 455 moves relative to the pin 452. In some instances, when a distal end of the arcuate shaped cutout 455 engages the pin 452, further pivotal movement about the neck pivot axis 404 is substantially prevented. For example, the neck 433 and the base portion 435 may come into engagement, preventing further pivoting of the neck 433 about the neck pivot axis 404 when the distal end of the arcuate shaped cutout 455 engages the pin 452.

The canister mount 450 may include one or more rails 456 for slideably receiving a canister which may include and/or be coupled to, for example, a debris collector and/or suction motor. The canister mount 450 may also include a canister mount body (or support) 458 that at least partially circumscribes at least a portion of the neck 433. In the example embodiment, the canister mount body 458 slideably engages at least a portion of the neck 433 such that the canister mount body 458 may rotate about the neck 433 and the wand longitudinal axis 401 in response to the neck 433 pivoting about the neck pivot axis 404. The neck 433 also includes a support clip 457 for supporting the canister mount 450, for example, when a canister is coupled to the canister mount 450. The support clip 457 may allow the canister mount 450 to slide relative to the neck 433 when rotating about the neck 433.

Figure 5:
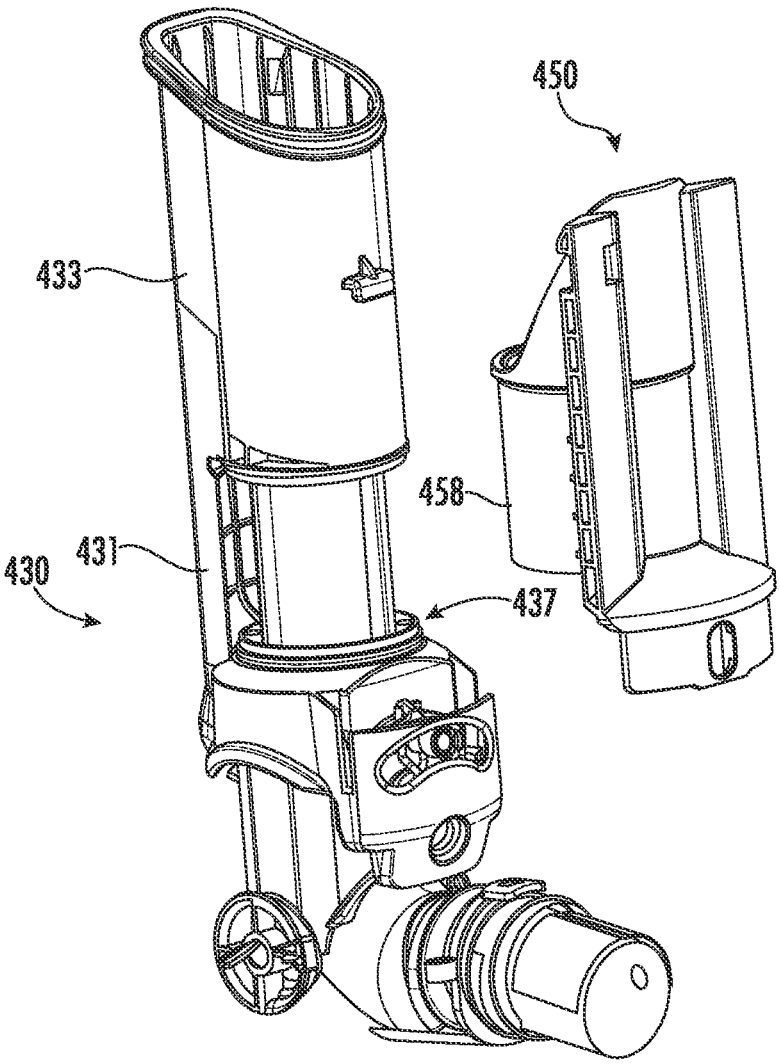
FIG. 5 is a perspective exploded view of the multiple axis pivot joint shown in FIG. 4 with the canister mount removed, consistent with embodiments of the present disclosure.

As shown in FIG. 5 (with the canister mount 450 removed), the neck 433 includes one or more sliding or bearing surfaces 437 that extend around at least a portion of the neck 433 and are capable of slideably engaging the canister mount body 458 such that the canister mount body 458 only slideably engages the neck 433 at the one or more bearing surfaces 437. In some instances, the one or more bearing surfaces 437 may include any one or more of a roller bearing, a ball bearing, and/or any other suitable bearing. Additionally, or alternatively, the bearing surfaces 437 may include a low friction material such as polytetrafluoroethylene (PTFE), nylon, ultrahigh-molecular-weight polyethylene (UHMWPE), and/or any other suitable low friction material. In some instances, the one or more bearing surfaces 437 may include a self-lubricating material.

The neck 433 may include a removable panel 431 that encloses at least a portion of the canister mount body 458. The removable panel 431 may be, for example, an electronics cover. The canister mount body 458 may slideably engage the one or more sliding surfaces 437 of the neck 433 without engaging the removable panel 431. In some instances, however, the canister mount body 458 may slideably engage at least a portion of the removable panel 431. When the canister mount body 458 does not slideably engage the removable panel 431, the canister mount 450 may be more compact when compared to the example having the canister mount body 458 slideably engaging at least a portion of the removable panel 431.

Figure 6:
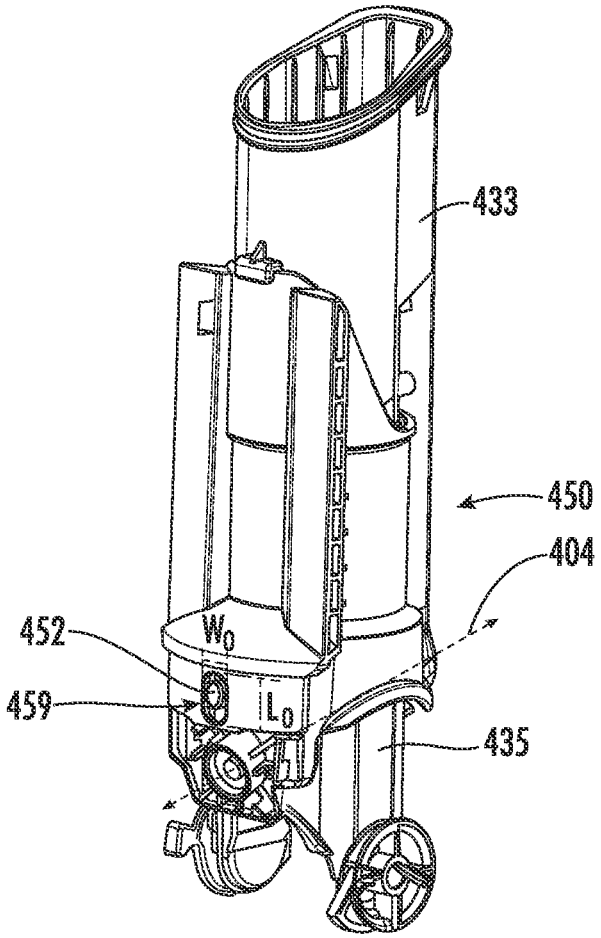
FIG. 6 is a perspective view of the multiple axis pivot joint of FIG. 4 showing the coupling between the canister mount and the multiple axis pivot joint, consistent with embodiments of the present disclosure.

As shown in FIG. 6, the canister mount 450 includes a slot 459 for receiving the pin 452 extending from the base portion 435 to allow the pin 452 to engage the canister mount 450 proximate a bottom end thereof. In this embodiment, the slot 459 extends through the bottom section (e.g., a bottom 10%, 20%, 30%, 40%, or 50%) of the canister mount 450 such that the pin 452 can be seen moving during use. The slot 459 may have a width $W_o$ substantially equal to a corresponding dimension of the spherical head of the pin 452 such that, when the neck 433 pivots about the neck pivot axis 404, a side of the slot 459 engages the head of the pin 452. The engagement between the pin 452 and sides of the slot 459 at least partially restricts movement of the canister mount 450 relative to the base portion 435 such that the canister mount 450 rotates relative to the neck 433 when the neck 433 is pivoted about the neck pivot axis 404.

A length $L_o$ of the slot 459 may be greater than a corresponding dimension of the pin 452 (e.g., the diameter of the spherical head) such that the pin 452 can move within the slot 459 in response to the neck 433 pivoting about the neck pivot axis 404. In other words, the position of the pin 452 relative to the slot 459 may change as the neck 433 pivots about the neck pivot axis 404.

Figure 7:
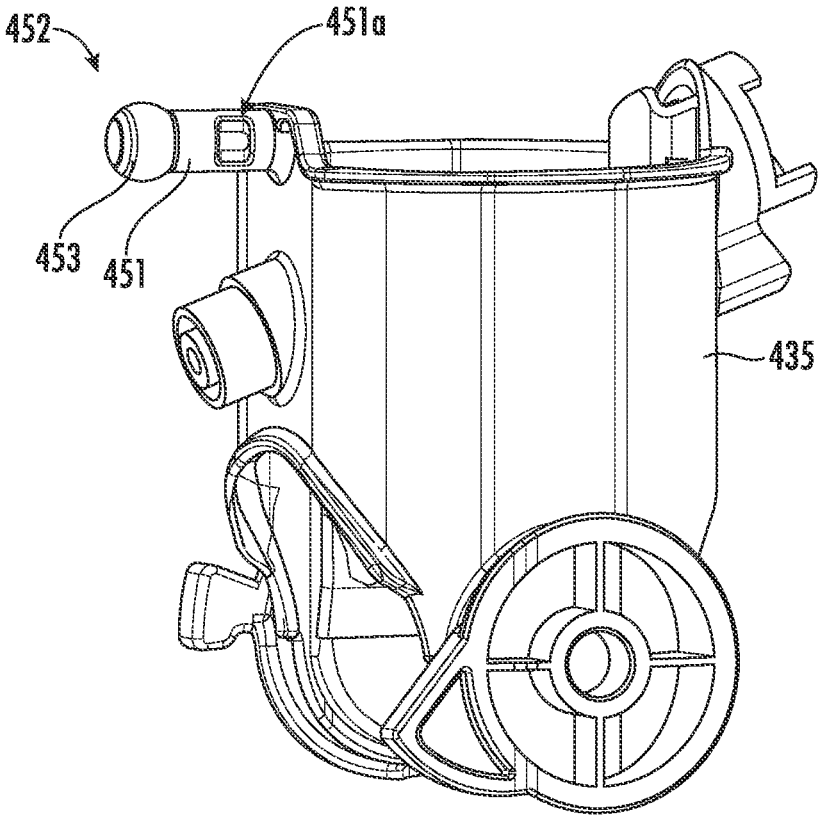
FIG. 7 is a side perspective view of a base portion of the multiple axis pivot joint of FIG. 4 showing the pin, consistent with embodiments of the present disclosure.

FIG. 7 shows the pin 452 extending from the base portion 435 in greater detail. The pin 452 may have a generally cylindrical body 451 and a spherical head 453 at a distal end of the cylindrical body 451. The cylindrical body 451 may include one or more notches 451*a* for engaging, for example, a bi-directional torsion spring, as will be discussed further herein. However, the body 451 may have any cross-sectional shape such as square shaped, pentagonal shaped, octagonal shaped, triangle shaped, trapezoidal shaped, and/or any other suitable shape. Further, the head 453 may have any cross-sectional shape such as square shaped, pentagonal shaped, octagonal shaped, triangle shaped, trapezoidal shaped, and/or any other suitable shape. The pin 452 may be formed as one piece with the base portion 435 (e.g., molded as one piece) or may be formed as a multiple part construction.

Figure 8:
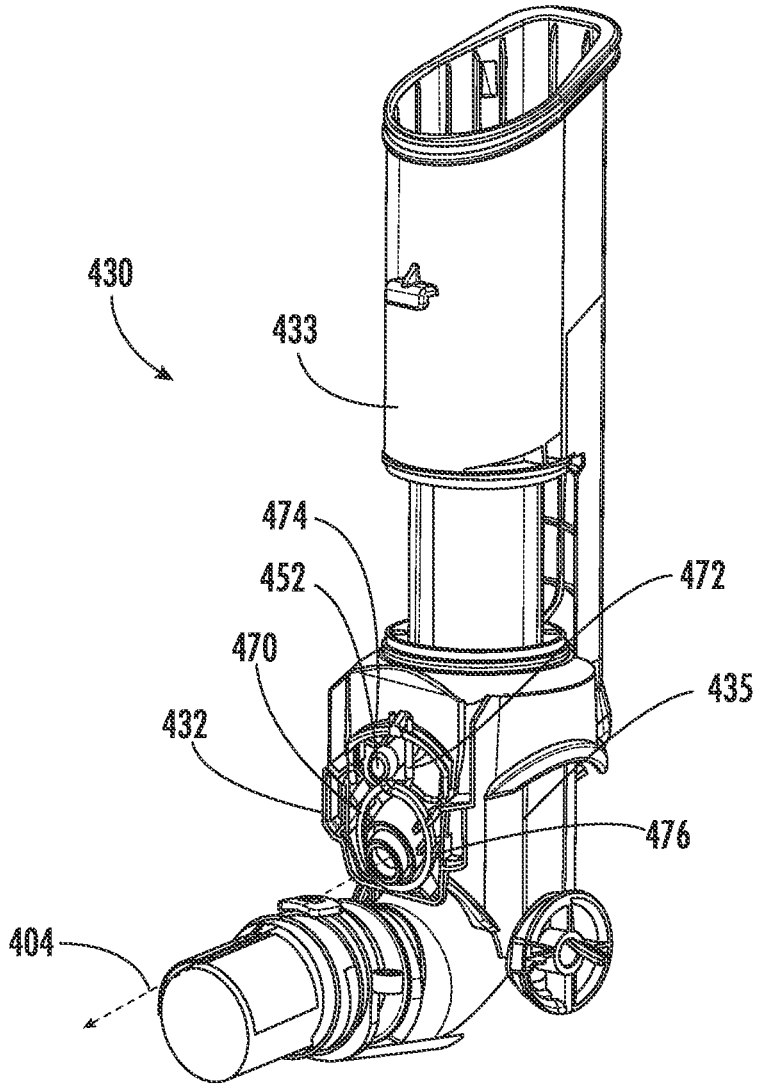
FIG. 8 is a perspective view the multiple axis pivot joint of FIG. 4 showing a bias mechanism, consistent with embodiments of the present disclosure.

As shown in FIG. 8, an embodiment of the multiple axis pivot joint 430 includes a bias mechanism 470 to bias the neck 433 toward an initial, generally upright position. In the illustrated embodiment, the bias mechanism 470 is secured to the neck 433 or upper pivoting member 432 and includes one or more arms 472 engaging the pin 452, for example, at the notch(es) 451*a* formed in the pin 452. As such, when the neck 433 pivots with the upper pivoting member 432 about the neck pivot axis 404, the arms 472 of the bias mechanism 470 may engage the pin 452 such that the bias mechanism 470 urges the neck 433 back to the initial position. The initial position may be the position at which the bias mechanism 470 is at rest (e.g., the bias mechanism 470 is not exerting a substantial force on the pin 452). The bias mechanism 470 may include a bi-directional torsion spring with a center of the torsion spring generally aligned with the neck pivot axis 404. Additionally, or alternatively, the bias mechanism 470 may include any one or more of an elastic material (e.g., a elastomeric/rubber belt or band), a spring (e.g., a compression spring, a leaf spring, a pneumatic spring, etc.), and/or any other suitable biasing mechanism.

As shown, the neck 433 or upper pivoting member 432 may include one or more guide tracks 474 for receiving at least the arm(s) 472 of the bias mechanism 470. The one or more guide tracks 474 may substantially restrict the movement of the bias mechanism 470 to a path defined by the guide tracks 474. The neck 433 or upper pivoting member 432 may also include one or more retaining structures 476 for receiving and retaining at least a portion of the bias mechanism 470. In some instances, the retaining structures 476 may couple the bias mechanism 470 to the neck 433 or upper pivoting member 432. The retaining structures 476 may be used to couple the bias mechanism 470 using one or more of a snap-fit, a press-fit, an adhesive, and/or any other suitable form of coupling.

Figure 9:
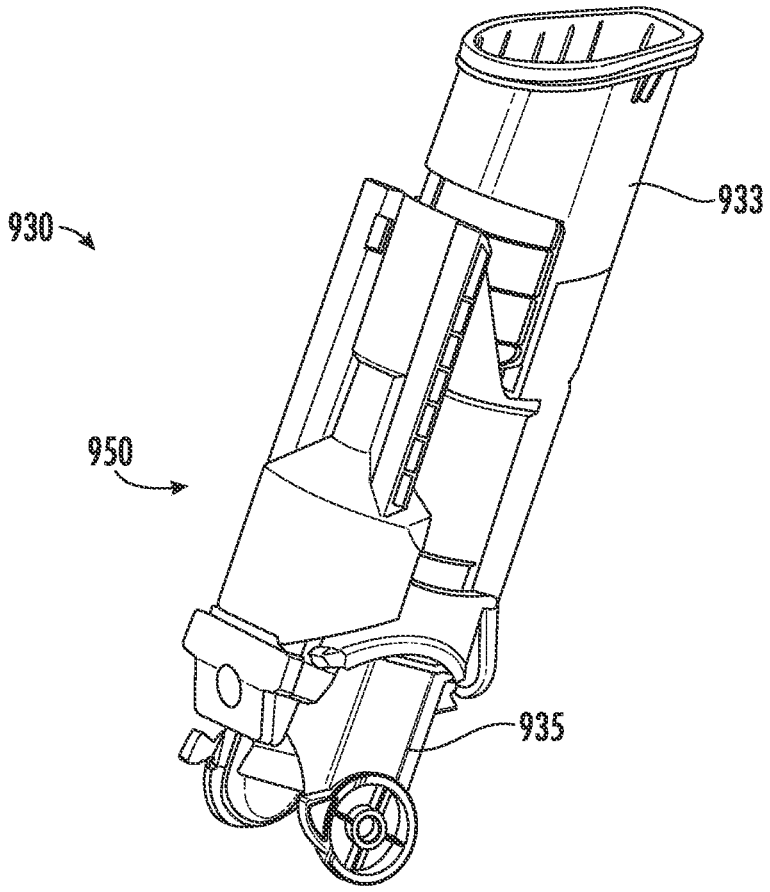
FIG. 9 is a perspective view of another embodiment of a multiple axis pivot joint having a rotatable canister mount for use in the upright vacuum cleaner of FIG. 1 to provide independent movement of the main body, consistent with embodiments of the present disclosure.

FIG. 9 shows a perspective view of another embodiment of a multiple axis pivot joint 930 and rotatable canister mount 950 providing independent movement for reducing wrist torque. The pivot joint 930 includes a neck 933 pivotally coupled to a base portion 935 with the rotatable canister mount 950 rotatably coupled to the neck 933 and engaged at a bottom with the base portion 935, similar to the embodiment described above. This embodiment of the multiple axis pivot joint 930 also includes a pin engaging a slot in the bottom portion of the rotatable canister mount 950, but the slot and the pin are hidden behind the canister mount 950. In this embodiment, the rotatable canister mount 950 is less constrained and thus may rotate more freely. Also, this embodiment does not include the plate with the arcuate shaped cutout which may limit pivoting of the neck 933.

Figure 10:
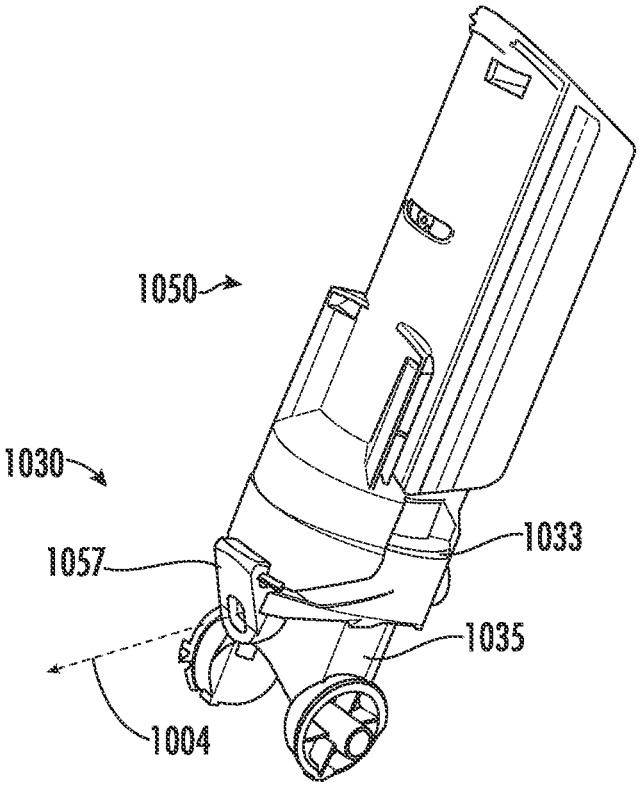
FIG. 10 is a perspective view of a further embodiment of a multiple axis pivot joint having a rotatable canister mount for use in the upright vacuum cleaner of FIG. 1 to provide independent movement of the main body, consistent with embodiments of the present disclosure.

FIG. 10 shows a perspective view of a further embodiment of a multiple axis pivot joint 1030 and a rotatable canister mount 1050 providing independent movement for reducing wrist torque. The pivot joint 1030 includes a neck 1033 pivotally coupled to a base portion 1035 with the rotatable canister mount 1050 rotatably coupled to the neck 1033 and engaged at a bottom section with the base portion 1035, similar to the embodiment described above. In this embodiment, the rotatable canister mount 1050 covers a substantial portion of the neck 1033 and a clip 1057 slidably engages a bottom edge of the rotatable canister mount 1050.

Figure 11A:
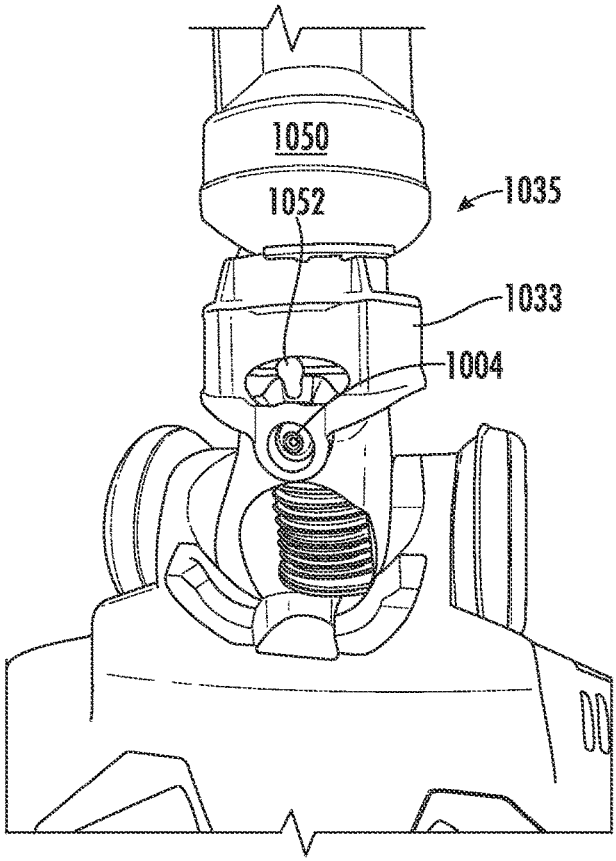
FIG. 11A is a perspective view of the multiple axis pivot joint of FIG. 10 with the canister mount removed to show the pin, consistent with embodiments of the present disclosure.
Figure 11B:
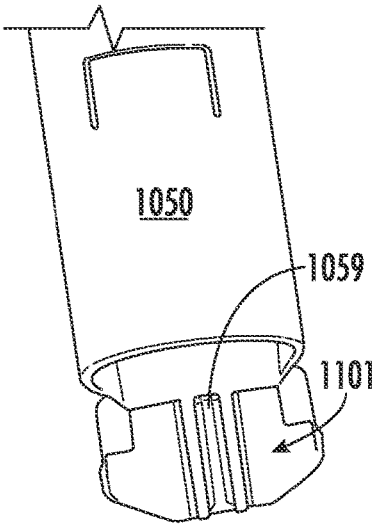
FIG. 11B is a side view of a back side of the canister mount shown in FIG. 11A showing the slot for receiving the pin, consistent with embodiments of the present disclosure.

As shown in FIGS. 11A and 11B, the base portion 1035 includes a pin 1052 and the rotatable canister mount 1050 includes a slot 1059 that receives the pin 1052. The slot 1059 extends along a pin facing surface 1101 of the canister mount 1050 (e.g., proximate a bottom section and/or distal end of the rotatable canister mount 1050). The pin facing surface 1101 is opposite an external surface of the rotatable canister mount 1050. As such, the pin 1052 is not observable when engaging the slot 1059. The pin 1052 resists and/or at least partially restricts movement of the canister mount 1050 when the wand and the neck 1033 pivot about the neck pivot axis 1004, thereby causing the canister mount 1050 to rotate relative to the neck 1033.

Figure 12A:
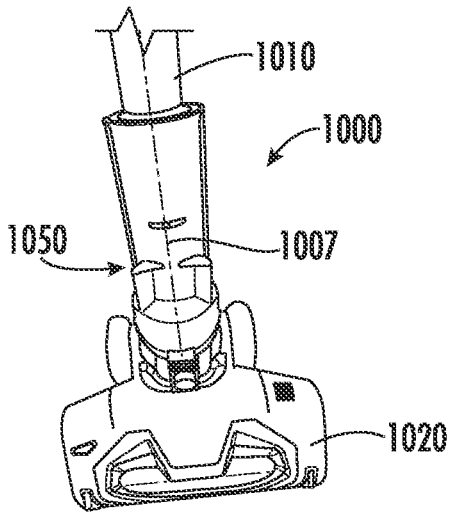
FIG. 12A is a perspective view of an upright vacuum cleaner including the multiple axis pivot joint and rotatable canister mount assembly of FIG. 10, consistent with embodiments of the present disclosure.
Figure 12B:
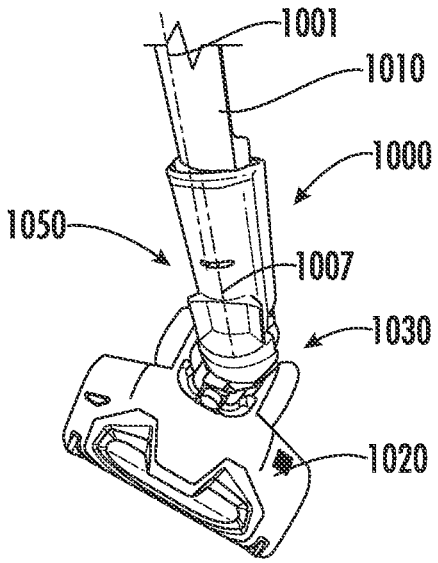
FIG. 12B is another perspective view of an upright vacuum cleaner of FIG. 12A, consistent with embodiments of the present disclosure.
Figure 12C:
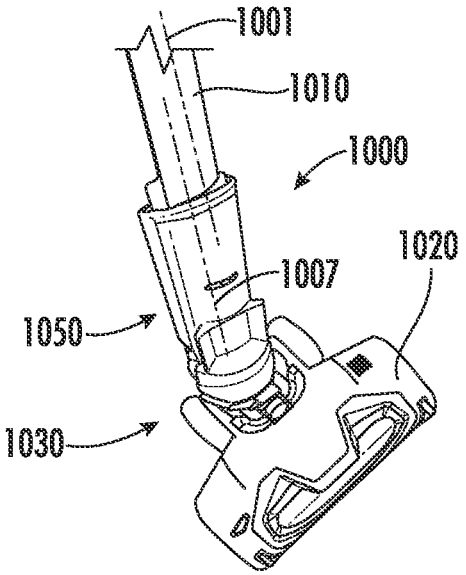
FIG. 12C is another perspective view of an upright vacuum cleaner of FIG. 12A, consistent with embodiments of the present disclosure.

FIGS. 12A-12C show the multiple axis pivot joint 1030 coupled to a surface cleaning head 1020 and to a wand 1010 of a vacuum cleaner 1000. FIG. 12A shows the wand 1010 in an initial upright position such that a center line 1007 of the canister mount 1050 is generally aligned with a center line 1001 of the wand 1010. FIGS. 12B and 12C show the wand 1010 in two different swiveled or rotated positions steering the surface cleaning head 1020 in two different directions. Because the rotatable canister mount 1050 does not rotate to the same extent as the wand 1010, in the swiveled or rotated positions, the center line 1007 of the canister mount 1050 is offset from the center line 1001 of the wand 1010 and thus the canister mount 1050 remains more upright.

Figure 13:
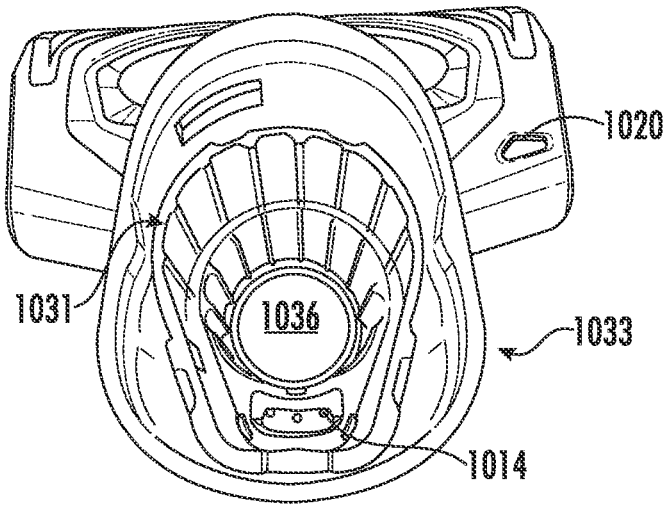
FIG. 13 is top view of the neck of the upright vacuum cleaner of FIGS. 12A-12C without the wand, consistent with embodiments of the present disclosure.

As shown in FIG. 13, the neck 1033 includes an opening 1031 for receiving the wand (not shown) and providing an airflow passageway 1036. The neck 1033 may also include one or more electrical contacts 1014 for carrying power to the surface cleaning head 1020, which may include, for example, a motor for driving a brush roll and one or more light sources.

Figure 14B:
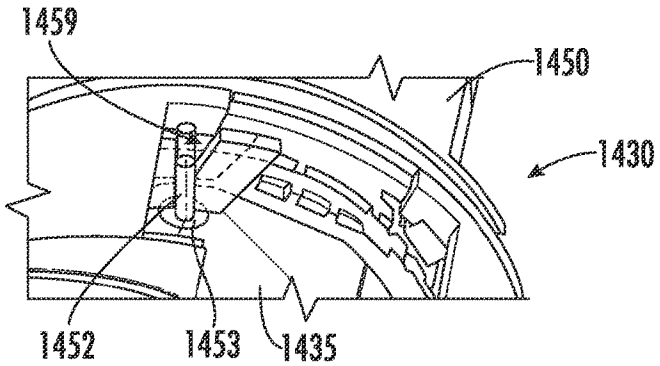
FIG. 14B is another perspective view of the coupling of FIG. 14A, consistent with embodiments of the present disclosure.
Figure 14D:
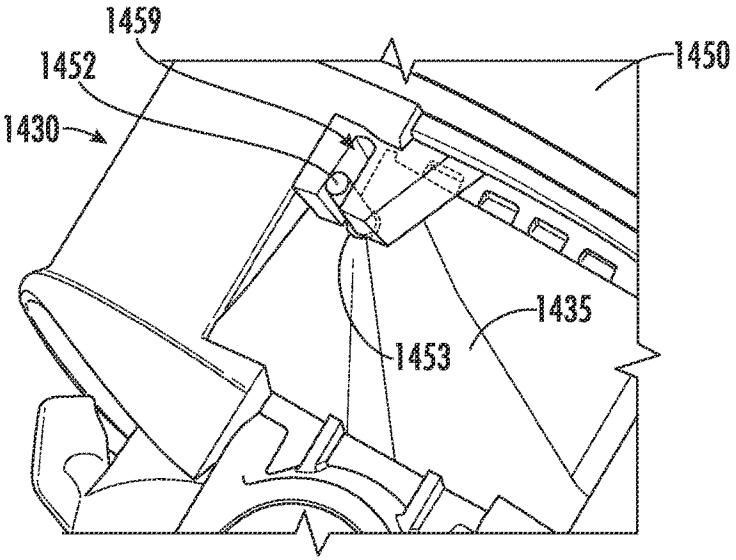
FIG. 14D is another perspective view of the coupling of FIG. 14A, consistent with embodiments of the present disclosure.
Figure 14A:
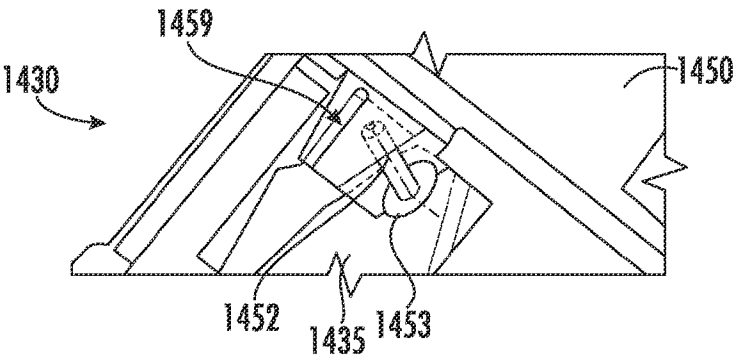
FIG. 14A is a perspective view of yet another embodiment of a coupling between a multiple axis pivot joint and a canister mount for use in an upright vacuum cleaner with a main body movable independent of a wand, consistent with embodiments of the present disclosure.
Figure 14C:
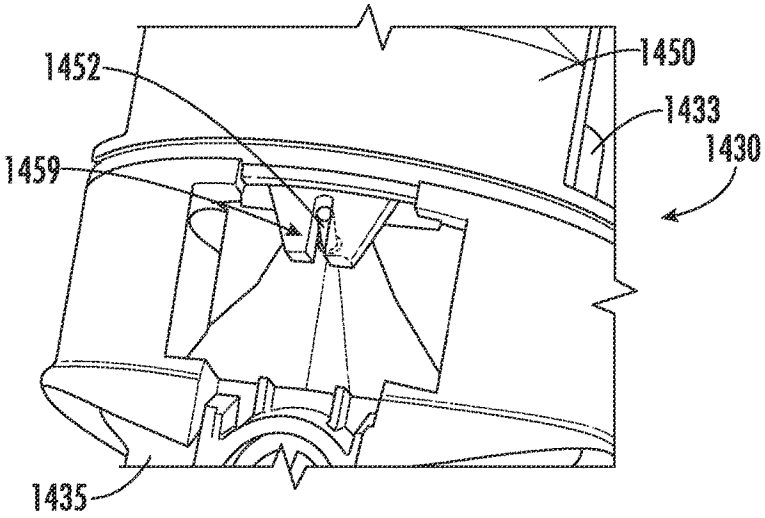
FIG. 14C is another perspective view of the coupling of FIG. 14A, consistent with embodiments of the present disclosure.

FIGS. 14A-14D show another embodiment of a coupling between a multiple axis pivot joint 1430 and a rotatable canister mount 1450. In this embodiment, a bent pin 1452 is received in a slot 1459 proximate a bottom end of the canister mount 1450 and configured to engage the bottom end of the canister mount 1450. The bent pin 1452 is rotatably coupled to the base portion 1435 using, for example, a bearing 1453. This keeps the sides of the pin 1452 substantially parallel with the slot 1459, which removes lateral play. When the pivot joint 1430 is vertical, as shown in FIGS. 14A and 14C, the bend in the pin 1452 is aligned with the vertical plane so the pin 1452 fits in the slot 1459 without interference. When the pivot joint 1430 is pivoted about the neck axis, as shown in FIGS. 14B and 14D, the pin 1452 causes the canister mount 1450 to rotate and the pin 1452 rotates to remain aligned with the slot 1459. As shown in FIGS. 14C and 14D, the pin 1452 causes the canister mount 1450 to move from a first position (FIG. 14C) to a second position (FIG. 14D) relative to the neck 1433 in response to the neck 1433 pivoting about the neck pivot axis.

Figure 15A:
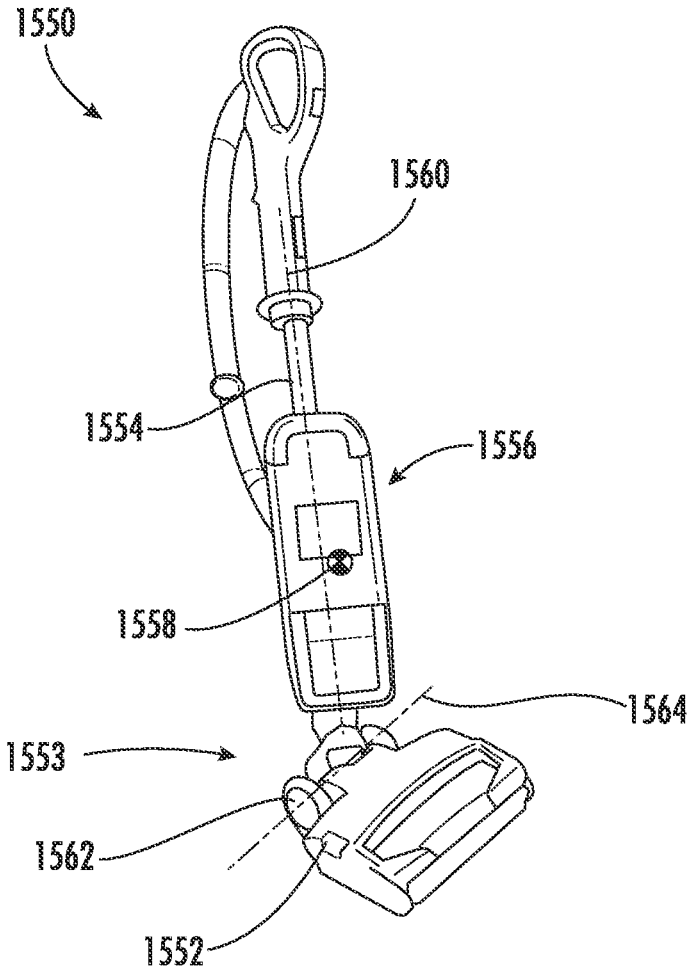
FIG. 15A shows a perspective view of a vacuum cleaner having a multiple axis pivot joint, consistent with embodiments of the present disclosure.

FIG. 15A shows an example of a vacuum cleaner 1550, which may be an example of the vacuum cleaner 100 of FIG. 1. As shown, the vacuum cleaner 1550 includes a surface cleaning head 1552 having a plurality of wheels 1562 coupled thereto along a wheel axis 1564, a multiple axis pivot joint 1553 coupled to the surface cleaning head 1552, a wand 1554 coupled to the multiple axis pivot joint 1553, and a main body 1556 coupled to the multiple axis pivot joint 1553. The main body 1556 is coupled to the multiple axis pivot joint 1553 such that a center of gravity 1558 of the main body 1556 does not rotate, relative to an operator of the vacuum cleaner 1550, about a wand axis 1560 of the wand 1554 in response to a corresponding rotation in the wand 1554 and/or the surface cleaning head 1552.

Figure 15B:
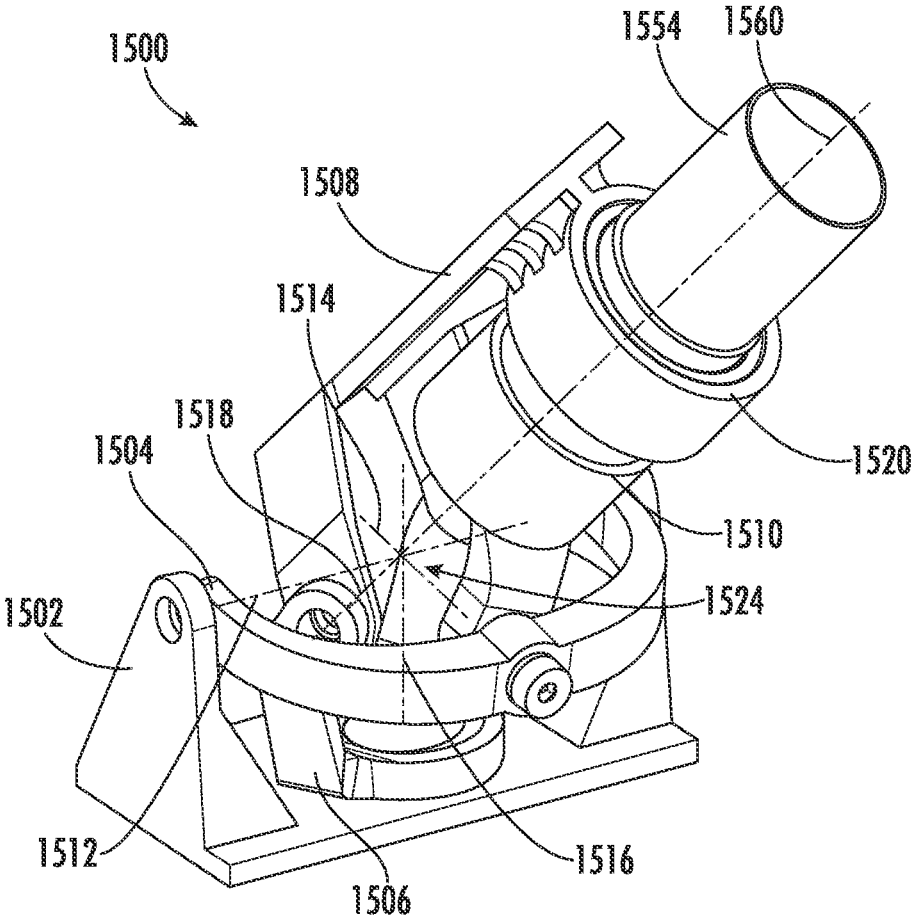
FIG. 15B shows a schematic perspective view of a multiple axis pivot joint, which may be capable of being used with the upright vacuum cleaner of FIG. 1, consistent with embodiments of the present disclosure.

FIG. 15B shows an example of a multiple axis pivot joint 1500 having at least four pivot axes and which may be an example of the multiple axis pivot joint 1553 of FIG. 15A. The multiple axis pivot joint 1500 can be configured such that the surface cleaning head 1552 and the wand 1554 move substantially independently from the main body 1556. As such, the vacuum cleaner 1550 can be maneuvered (e.g., steered) without having the center of gravity 1558 of the main body 1556 shift about the wand 1554, relative to an operator of the vacuum cleaner 1550, when the vacuum cleaner 1550 is steered. Such a configuration may generally be described as resulting in reduced operator fatigue when compared to a vacuum cleaner wherein the main body moves with the wand.

As shown, the multiple axis pivot joint 1500 includes a frame 1502 (which, may be monolithically formed from the surface cleaning head 1552 or configured to be coupled to at least a portion of the surface cleaning head 1552), a wand swivel gimbal 1504, a body swivel gimbal 1506, a mount 1508 for receiving, for example, at least a portion of the main body 1556, and a receptacle 1510 for receiving, for example, at least a portion of the wand 1554. The frame 1502 is pivotally coupled to the wand swivel gimbal 1504 along a first wand swivel (or pivot) axis 1512 and the receptacle 1510 is pivotally coupled to the wand swivel gimbal 1504 along a second wand swivel (or pivot) axis 1514. The frame 1502 is also pivotally coupled to the body swivel gimbal 1506 along a first body swivel (or pivot) axis 1516 and the mount 1508 is pivotally coupled to the body swivel gimbal 1506 along a second body swivel (or pivot) axis 1518.

As also shown, at least a portion of the wand 1554 is received within the receptacle 1510 and at least a portion passes (extends) through a support (or canister mount body) 1520 extending from the mount 1508. The support 1520 may be configured such that the wand 1554 is capable of rotating relative to the support 1520 about the wand axis 1560 extending along the wand 1554. In other words, the wand 1554 connects the wand swivel gimbal 1504 and the receptacle 1510 to the body swivel gimbal 1506 and the mount 1508 such that the wand swivel gimbal 1504, the body swivel gimbal 1506, the mount 1508, and the receptacle 1510 cooperate to facilitate the movement of the wand relative to, for example, the frame 1502. Therefore, the multiple axis pivot joint 1500 may generally be described as having at least four pivot axes (e.g., the first wand swivel axis 1512, the second wand swivel axis 1514, the first body swivel axis 1516, and the second body swivel axis 1518).

In some instances, the first and second wand swivel axes 1512 and 1514, the first and second body swivel axes 1516 and 1518, and the wand axis 1560 all intersect at a common point 1524. Such a configuration may allow the multiple axis pivot joint 1500 to utilize only pivotal connections. However, in instances where at least one of the first and second wand swivel axes 1512 and 1514, the first and second body swivel axes 1516 and 1518, and the wand axis 1560 does not intersect at the common point 1524, the multiple axis pivot joint 1500 may include one or more linear sliding joints to compensate.

Figure 16:
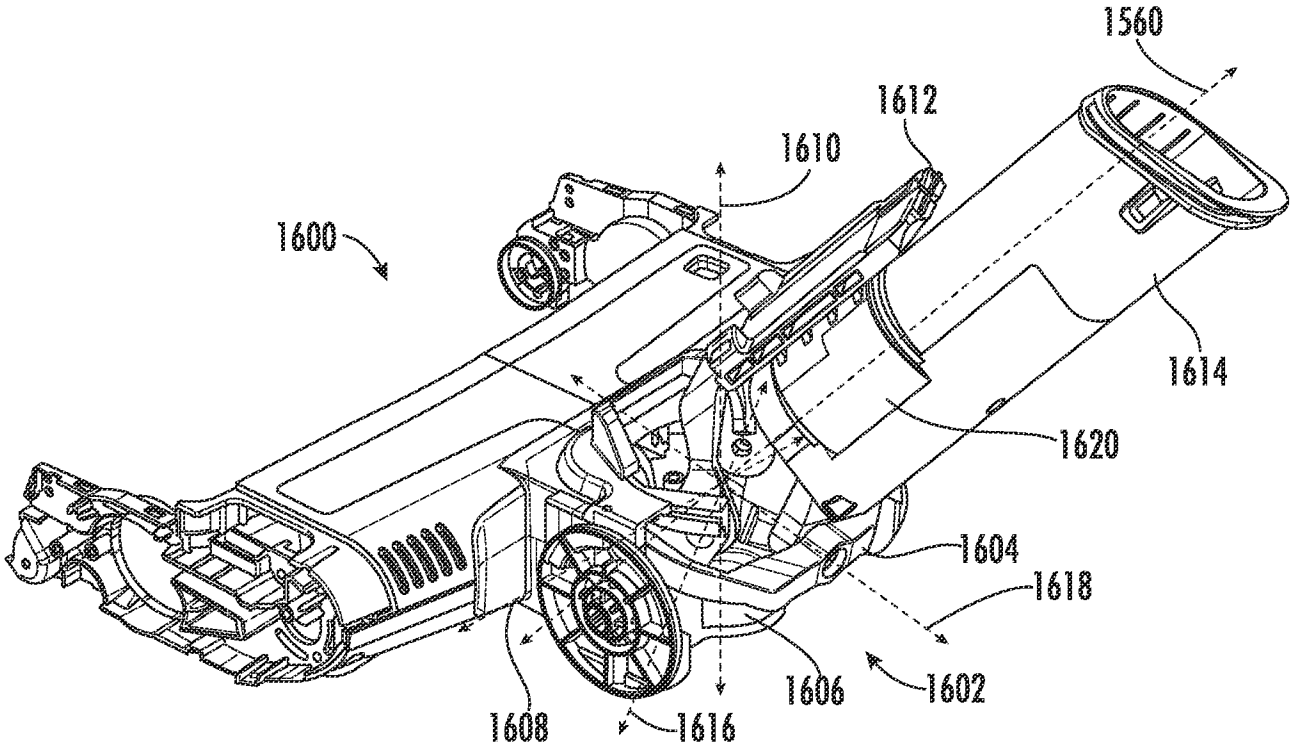
FIG. 16 shows a perspective view of an example of the multiple axis pivot joint of FIG. 15 coupled to a surface cleaning head, consistent with embodiments of the present disclosure.

FIG. 16 shows an example of a portion of a surface cleaning head 1600 (which may be an example of the surface cleaning head 1552 of FIG. 15A) having a multiple axis pivot joint 1602 (which may be an example of the multiple axis pivot joint 1500 of FIG. 15). As shown, the multiple axis pivot joint 1602 includes a wand swivel gimbal 1604 and a body swivel gimbal 1606 pivotally coupled to a portion of the surface cleaning head 1600. The wand swivel gimbal 1604 rotates about a first wand swivel (or pivot) axis 1608 and the body swivel gimbal 1606 rotates about a first body swivel (or pivot) axis 1610. As shown, the multiple axis pivot joint 1602 also includes a mount 1612 configured to, for example, couple to the main body 1556 and a receptacle 1614 configured to, for example, receive at least a portion of the wand 1554. The mount 1612 is pivotally coupled to the body swivel gimbal 1606 such that the mount 1612 rotates about a second body swivel (or pivot) axis 1616 and the receptacle 1614 is pivotally coupled to the wand swivel gimbal 1604 such that the receptacle 1614 rotates about a second wand swivel (or pivot) axis 1618.

When the wand 1554 is received within the receptacle 1614, the wand 1554 may be prevented from rotating relative to the receptacle 1614. In other words, the wand 1554 and the receptacle 1614 are configured to rotate together about the wand axis 1560 that extends longitudinally along the wand 1554 and the receptacle 1614. Rotation of the wand 1554 about the wand axis 1560 causes a corresponding rotation in the surface cleaning head 1600 about a pivot axis extending parallel to, for example, the first body swivel axis 1610. In some instances, the surface cleaning head 1600 may rotate about the first body swivel axis 1610 in response to a rotation of the wand 1554 about the wand axis 1560.

As shown, the mount 1612 includes a support (or canister mount body) 1620 that extends around at least a portion of the receptacle 1614. The support 1620 may be configured to slideably engage at least a portion of the receptacle 1614 such that the receptacle 1614 can rotate independently of the support 1620. As such, when the wand 1554 is rotated, the mount 1612 does not rotate with the receptacle 1614. Therefore, when the main body 1556 is coupled to the mount 1612, the center of gravity 1558 of the main body 1556 rotates relative to the wand axis 1560 such that the center of gravity 1558 of the main body 1556 does not move angularly around the wand axis 1560 relative to an operator of the vacuum cleaner 1550. As a result, the vacuum cleaner 1550 can be maneuvered (e.g., steered) without having the center of gravity 1558 of the main body 1556 rotate relative to an operator of the vacuum cleaner 1550. In other words, the wand 1554 and the surface cleaning head 1600 are capable of rotating independently of the main body 1556.

For example, a rotation of the wand 1554 about the wand axis 1560 causes a corresponding rotation in the wand swivel gimbal 1604 and the receptacle 1614. The rotation of the wand swivel gimbal 1604 urges the surface cleaning head 1600 to rotate about an axis perpendicular to, for example, a surface to be cleaned. The surface cleaning head 1600 rotates relative to the body swivel gimbal 1606 and the mount 1612. In other words, the body swivel gimbal 1606 and the mount 1612 do not rotate relative to an operator of the vacuum cleaner 1550 in response to a rotation of the wand 1554 about the wand axis 1560. As a result, when the main body 1556 is coupled to the mount 1612, the center of gravity 1558 of the main body 1556 may generally be described as remaining rotationally fixed relative to an operator of the vacuum cleaner 1550. In other words, the wand 1554 and the surface cleaning head 1600 are capable of rotating independently of the main body 1556.

By way of further example, when the wand 1554 is rotated about the second wand swivel axis 1618, an operator of the vacuum cleaner 1550 can apply a force on the wand swivel gimbal 1604 along the first wand swivel axis 1608 such that the force is transmitted to the surface cleaning head 1600 and causes the surface cleaning head 1600 to turn. As the wand 1554 rotates about the second wand swivel axis 1618, the body swivel gimbal 1606 and the mount 1612 rotate relative to the surface cleaning head 1600. As a result, the center of gravity 1558 of the main body 1556 may generally be described as remaining rotationally fixed relative to an operator of the vacuum cleaner 1550. In other words, the wand 1554 and the surface cleaning head 1600 are capable of rotating independently of the main body 1556.

Figure 17:
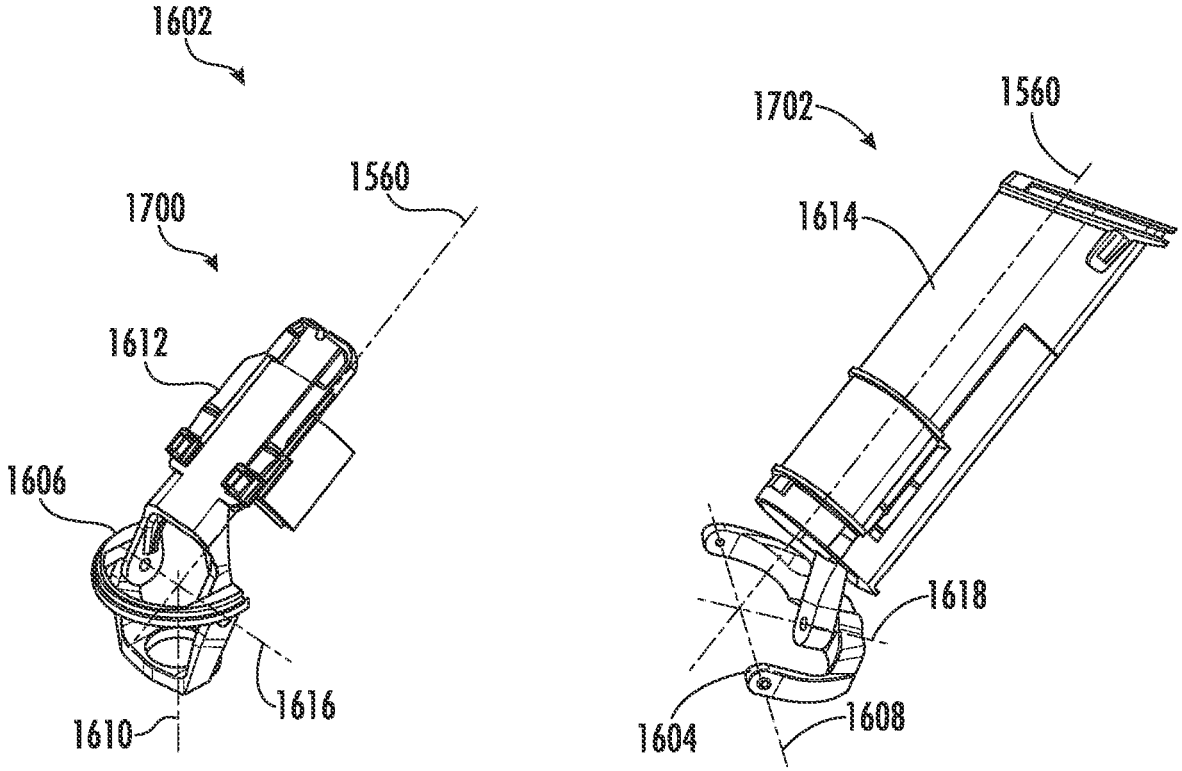
FIG. 17 shows an exploded view of the multiple axis pivot joint of FIG. 16, consistent with embodiments of the present disclosure.

FIG. 17 is an exploded view of the multiple axis pivot joint 1602 of FIG. 16. As shown, the body swivel gimbal 1606 and the mount 1612 may generally be described as forming a body swivel joint 1700 and the wand swivel gimbal 1604 and the receptacle 1614 may generally be described as forming a wand swivel joint 1702.

The body swivel joint 1700 has at least two degrees of rotational freedom (e.g., at least two pivot axes), which cooperate to allow the main body 1556 of the vacuum cleaner 1550 to be angularly fixed about the wand axis 1560 relative to an operator of the vacuum cleaner 1550 (e.g., the main body 1556 is substantially prevented from rotating around the wand axis 1560 relative to an operator of the vacuum cleaner 1550). The first body swivel axis 1610 extends substantially vertically (e.g., substantially perpendicular to a surface being cleaned) and the second body swivel axis 1616 extends substantially horizontally (e.g., substantially parallel to the surface being cleaned). Therefore, the first body swivel axis 1610 may generally be described as allowing the main body 1556 to slew side to side and second body swivel axis 1616 may generally be described as allowing the main body 1556 to recline from, for example, an upright position to an in-use position.

The wand swivel joint 1702 also has at least two degrees of rotational freedom (e.g., at least two pivot axes), which cooperate to allow an operator to maneuver (e.g., steer) the vacuum cleaner 1550. The first wand swivel axis 1608 extends transverse to a direction of movement of the vacuum cleaner 1550 (e.g., parallel to the wheel axis 1564 about which the plurality of wheels 1562 rotate when the vacuum cleaner 1550 is moved). The second wand swivel axis 1618 extends in a direction transverse to the first wand swivel axis 1608 (e.g., perpendicular to the first wand swivel axis 1608).

Figure 18:
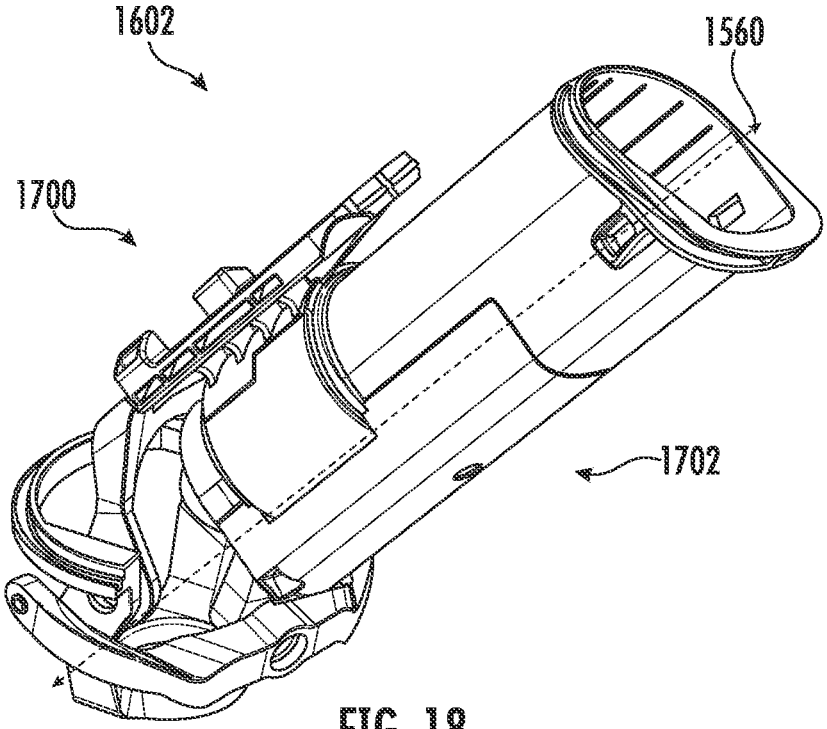
FIG. 18 shows a perspective view of the multiple axis pivot joint of FIG. 16, consistent with embodiments of the present disclosure.

FIG. 18 shows an example of the multiple axis pivot joint 1602. As shown, at least a portion of the body swivel joint 1700 (e.g., the support 1620) extends around at least a portion of the wand swivel joint 1702 such that body swivel joint 1700 and the wand swivel joint 1702 are capable of independent rotation (relative to each other) about the wand axis 1560. As such, the center of gravity 1558 of the main body 1556 can generally be described as remaining rotationally fixed relative to an operator of the vacuum cleaner 1550.

Figure 19:
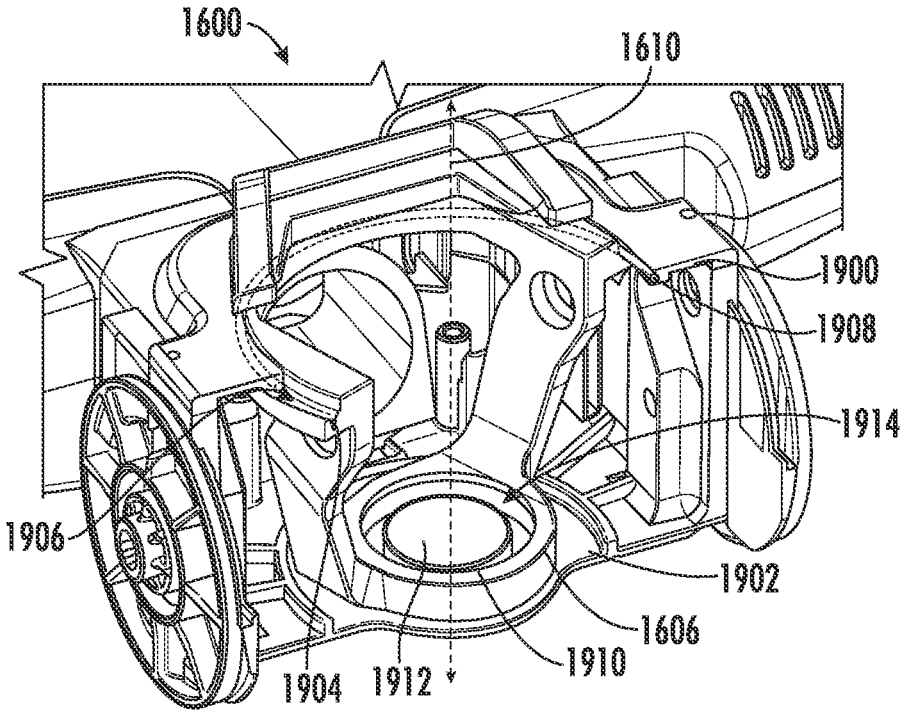
FIG. 19 shows a perspective view of a cleaning head having a portion of the multiple axis pivot joint of FIG. 16 coupled thereto, consistent with embodiments of the present disclosure.

FIG. 19 shows an example of the surface cleaning head 1600 having the body swivel gimbal 1606 coupled thereto. As shown, the body swivel gimbal 1606 is disposed between a top surface 1900 and a bottom surface 1902 of the surface cleaning head 1600. The body swivel gimbal 1606 may include a groove 1904 extending along an upper-facing surface 1906 (e.g., a surface facing away from a surface to be cleaned) for receiving a corresponding track 1908 that extends from the top surface 1900. The body swivel gimbal 1606 may also include an opening 1910 for receiving a protrusion 1912 extending from the bottom surface 1902 of the surface cleaning head 1600. A passageway 1914 may extend between the opening 1910 and the protrusion 1912. The passageway 1914 may be configured to receive, for example, at least a portion of a bearing and/or a biasing mechanism. When the body swivel gimbal 1606 is rotated, the groove 1904 is configured to slideably engage the track 1908 and the bottom surface 1902 of the surface cleaning head 1600 is configured to slideably engage a surface of the body swivel gimbal 1606. Therefore, the body swivel gimbal 1606 may generally be described as being configured to slideably engage at least a portion of the surface cleaning head 1600. While FIG. 19 shows the body swivel gimbal 1606 as including a groove 1904 configured to receive the track 1908 and an opening 1910 configured to receive the protrusion 1912, such a configuration is not required.

Therefore, the body swivel gimbal 1606 may generally be described as being retained within the surface cleaning head 1600 by the top and bottom surfaces 1900 and 1902 such that the body swivel gimbal 1606 slideably engages at least a portion of the surface cleaning head 1600. As a result, the body swivel gimbal 1606 provides structural support for the surface cleaning head 1600. This may increase the stiffness and/or stability of the surface cleaning head 1600. By positioning the body swivel gimbal 1606 between the top and bottom surfaces 1900 and 1902 of the surface cleaning head 1600, the orientation of the first body swivel axis 1610, relative to the surface to be cleaned, may be maintained. For example, the body swivel axis 1610 may extend perpendicular to the surface to be cleaned. Further, positioning the body swivel gimbal 1606 between the top and bottom surfaces 1900 and 1902 may reduce, for example, the quantity of noise generated due to movement (e.g., rattling) of components within the surface cleaning head 1600.

Figure 20:
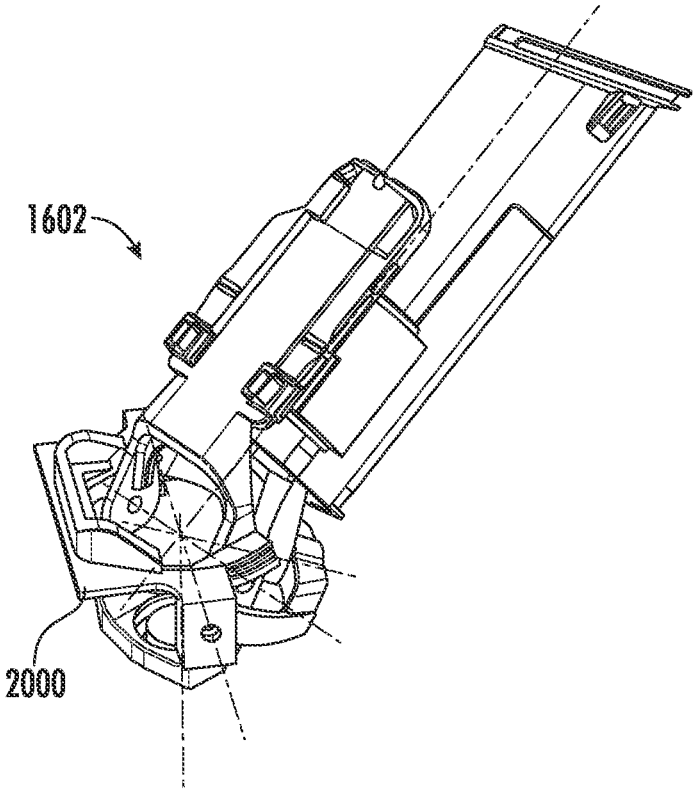
FIG. 20 shows a perspective view of the multiple axis pivot joint of FIG. 16 having a mounting plate configured to couple to a surface cleaning head, consistent with embodiments of the present disclosure.

FIG. 20 shows another example of the multiple axis pivot joint 1602. As shown, the multiple axis pivot joint 1602 may include a mounting plate 2000 configured to couple to, for example, at least a portion of the surface cleaning head 1600.

Figure 21:
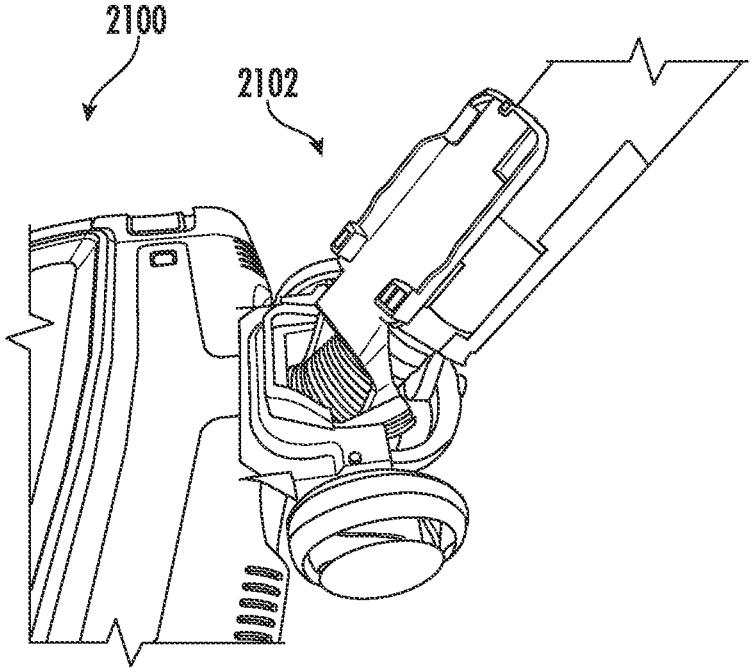
FIG. 21 shows a perspective view of a surface cleaning head having a multiple axis pivot joint, consistent with embodiments of the present disclosure.

FIG. 21 shows an example of a surface cleaning head 2100 having a multiple axis pivot joint 2102, which may be an example of the multiple axis pivot joint 1500 or the multiple axis pivot joint 1602.

Figure 22:
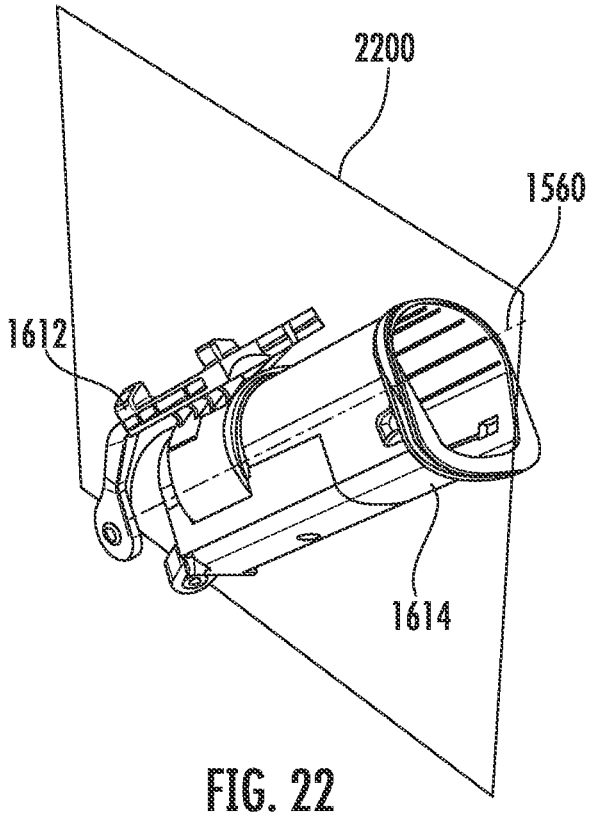
FIG. 22 shows a portion of the multiple axis pivot joint of FIG. 16, consistent with embodiments of the present disclosure.

FIG. 22 shows an example the mount 1612 coupled to the receptacle 1614 such that the mount 1612 rotates relative to the receptacle 1614 about, for example, the wand axis 1560. As shown, the wand axis 1560 may extend within a central plane 2200 of the mount 1612 (and/or the main body 1556).

According to one aspect of the present disclosure there is provided a vacuum cleaner. The vacuum cleaner may include a surface cleaning head, a wand pivotally coupled to the surface cleaning head, and a rotatable canister mount. The rotatable canister mount may include a support through which at least a portion of the wand extends such that the rotatable canister mount rotates relative to the wand in response to the wand pivoting.

In some instances, the vacuum cleaner may include a pivot joint that pivotally couples the wand to the surface cleaning head. In some instances, the pivot joint defines at least four pivot axes. In some instances, the pivot joint includes a body swivel joint and a wand swivel joint. In some instances, the body swivel joint includes a body swivel gimbal pivotally coupled to the surface cleaning head and defining a first body pivot axis. In some instances, the rotatable canister mount is pivotally coupled to the body swivel gimbal and defines a second body pivot axis. In some instances, the wand swivel joint includes a wand swivel gimbal pivotally coupled to the surface cleaning head and defining a first wand pivot axis. In some instances, the wand swivel joint further includes a receptacle configured to receive at least a portion of the wand, the receptacle being pivotally coupled to the wand swivel gimbal and defining a second wand pivot axis. In some instances, the wand is configured to pivot about at least a first pivot axis and a second pivot axis. In some instances, the first pivot axis is parallel to a direction of movement of the vacuum cleaner. In some instances, the second pivot axis is transverse to the first pivot axis.

According to another aspect of the present disclosure there is provided an upright vacuum cleaner. The upright vacuum cleaner may include a surface cleaning head, a wand having a longitudinal axis, a pivot joint pivotally coupling the wand to the surface cleaning head such that the wand rotates about the longitudinal axis, and a main body movably coupled to the wand. The main body may move independently of the wand such that a center of gravity of the main body rotates about the longitudinal axis of the wand to a lesser extent than the wand rotates about the longitudinal axis.

In some instances, the pivot joint includes a body swivel joint and a wand swivel joint. In some instances, the body swivel joint includes a body swivel gimbal pivotally coupled to the surface cleaning head. In some instances, the upright vacuum cleaner may include a mount configured to couple to the main body, the mount being pivotally coupled to the body swivel gimbal. In some instances, the wand swivel joint includes a wand swivel gimbal pivotally coupled to the surface cleaning head. In some instances, the wand swivel joint further includes a receptacle configured to receive at least a portion of the wand, the receptacle being pivotally coupled to the wand swivel gimbal.

According to another aspect of the present disclosure there is provided a multiple axis pivot joint for a vacuum cleaner. The multiple axis pivot joint may include a frame, a wand swivel gimbal pivotally coupled to the frame, a body swivel gimbal pivotally coupled to the frame, a mount configured to couple to a main body of the vacuum cleaner, the mount being pivotally coupled to the body swivel gimbal, and a receptacle configured to receive at least a portion of a wand of the vacuum cleaner, the receptacle being pivotally coupled to the wand swivel gimbal.

In some instances, the wand swivel gimbal defines a first wand pivot axis and the receptacle defines a second wand pivot axis. In some instances, the body swivel gimbal defines a first body pivot axis and the mount defines a second body pivot axis.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A vacuum cleaner comprising:

a surface cleaning head;

a wand pivotally coupled to the surface cleaning head; and a rotatable canister mount having a support through which at least a portion of the wand extends such that the rotatable canister mount rotates relative to the wand in response to the wand pivoting.

2. The vacuum cleaner of claim 1, further comprising a pivot joint that pivotally couples the wand to the surface cleaning head.

3. The vacuum cleaner of claim 2, wherein the pivot joint defines at least four pivot axes.

4. The vacuum cleaner of claim 2, wherein the pivot joint includes a body swivel joint and a wand swivel joint.

5. The vacuum cleaner of claim 4, wherein the body swivel joint includes a body swivel gimbal pivotally coupled to the surface cleaning head and defining a first body pivot axis.

6. The vacuum cleaner of claim 5, wherein the rotatable canister mount is pivotally coupled to the body swivel gimbal and defines a second body pivot axis.

7. The vacuum cleaner of claim 4, wherein the wand swivel joint includes a wand swivel gimbal pivotally coupled to the surface cleaning head and defining a first wand pivot axis.

8. The vacuum cleaner of claim 7, wherein the wand swivel joint further includes a receptacle configured to receive at least a portion of the wand, the receptacle being pivotally coupled to the wand swivel gimbal and defining a second wand pivot axis.

9. The vacuum cleaner of claim 1, wherein the wand is configured to pivot about at least a first pivot axis and a second pivot axis.

10. The vacuum cleaner of claim 9, wherein the first pivot axis is parallel to a direction of movement of the vacuum cleaner.

11. The vacuum cleaner of claim 10, wherein the second pivot axis is transverse to the first pivot axis.

12. An upright vacuum cleaner comprising:

a surface cleaning head;

a wand having a longitudinal axis;

a pivot joint pivotally coupling the wand to the surface cleaning head such that the wand rotates about the longitudinal axis; and a main body movably coupled to the wand, wherein the main body moves independently of the wand such that a center of gravity of the main body rotates about the longitudinal axis of the wand to a lesser extent than the wand rotates about the longitudinal axis.

13. The upright vacuum cleaner of claim 12, wherein the pivot joint includes a body swivel joint and a wand swivel joint.

14. The upright vacuum cleaner of claim 13, wherein the body swivel joint includes a body swivel gimbal pivotally coupled to the surface cleaning head.

15. The upright vacuum cleaner of claim 14, further comprising a mount configured to couple to the main body, the mount being pivotally coupled to the body swivel gimbal.

16. The upright vacuum cleaner of claim 14, wherein the wand swivel joint includes a wand swivel gimbal pivotally coupled to the surface cleaning head.

17. The upright vacuum cleaner of claim 16, wherein the wand swivel joint further includes a receptacle configured to receive at least a portion of the wand, the receptacle being pivotally coupled to the wand swivel gimbal.

18. A multiple axis pivot joint for a vacuum cleaner comprising:

a frame;

a wand swivel gimbal pivotally coupled to the frame;

a body swivel gimbal pivotally coupled to the frame;

a mount configured to couple to a main body of the vacuum cleaner, the mount being pivotally coupled to the body swivel gimbal, wherein the mount includes a support, the support being configured such that a wand of the vacuum cleaner is moveable relative to the support about a longitudinal axis of the wand; and a receptacle configured to receive at least a portion of the wand of the vacuum cleaner, the receptacle being pivotally coupled to the wand swivel gimbal.

19. The multiple axis pivot joint of claim 18, wherein the wand swivel gimbal defines a first wand pivot axis and the receptacle defines a second wand pivot axis.

20. The multiple axis pivot joint of claim 18, wherein the body swivel gimbal defines a first body pivot axis and the mount defines a second body pivot axis.

* * * * *